US006638707B2

(12) United States Patent
Takeyama

(10) Patent No.: US 6,638,707 B2
(45) Date of Patent: Oct. 28, 2003

(54) PHOTOTHERMOGRAPHIC MATERIAL

(75) Inventor: Toshihisa Takeyama, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/174,342

(22) Filed: Jun. 17, 2002

(65) Prior Publication Data

US 2003/0044738 A1 Mar. 6, 2003

(30) Foreign Application Priority Data

Jun. 26, 2001 (JP) ..... 2001-192698

(51) Int. Cl.[7] ..... G03C 1/498

(52) U.S. Cl. ..... 430/619; 430/523; 430/531; 430/620; 430/631

(58) Field of Search ..... 430/619, 523, 430/531, 631, 620

(56) References Cited

U.S. PATENT DOCUMENTS

| | | | |
|---|---|---|---|
| 5,856,062 | A | 1/1999 | Hoshi |
| 6,060,228 | A | 5/2000 | Suzuki |

FOREIGN PATENT DOCUMENTS

| | | | |
|---|---|---|---|
| EP | 1 136 877 | A | 9/2001 |
| JP | 2002-23304 | A | 1/2002 |

*Primary Examiner*—Thorl Chea
(74) *Attorney, Agent, or Firm*—Frishauf, Holtz, Goodman & Chick, P.C.

(57) ABSTRACT

A photothermographic material is disclosed, comprising a support having thereon an image forming layer containing an organic silver salt, further thereon a protective layer and optionally an interlayer between the support and the image forming layer, wherein at least one of the image forming layer and the interlayer contains an alkoxy-silane compound having at least two primary or secondary amino groups or a salt thereof or a Schiff base formed through dehydration condensation of an alkoxy-silane compound having at least one primary amino group and a ketone compound.

10 Claims, No Drawings

PHOTOTHERMOGRAPHIC MATERIAL

FIELD OF THE INVENTION

The present invention relates to photothermographic materials and image recording method by the use thereof.

BACKGROUND OF THE INVENTION

In the field of graphic arts and medical treatment, there have been concerns in processing of photographic film with respect to effluent produced from wet-processing of image forming materials, and recently, reduction of the processing effluent is strongly demanded in terms of environmental protection and space saving. There has been desired a photothermographic dry imaging material for photographic use, capable of forming distinct black images exhibiting high sharpness, enabling efficient exposure by means of a laser imager or a laser image setter. Known as such a technique are thermally developable silver salt photographic materials (which are the same as photothermographic materials, as described in the present invention) comprising on a support an organic silver salt, light-sensitive silver halide and a reducing agent, as described in D. Morgan and B. Shely, U.S. Pat. Nos. 3,152,904 and 3,487,075, and D. H. Klosterboer, "Thermally Processed Silver Systems" in IMAGING PROCESSES and MATERIALS, Neblette's Eighth Edition, edited by J. M. Sturge, V. Walworth, and A. Shepp (1969) page 279. The thermally developable silver salt photographic material provides a simply and environment-friendly system for users, without using any processing solution.

There was proposed a photothermographic material, in which compounds, called a contrast-increasing agent or silver-saving agent were incorporated, resulting in higher densities relative to a photothermographic material not containing such compounds, in the case of silver coverage being equal. Various compounds, as a contrast-increasing agent or silver-saving agent (hereinafter, denoted as a silver-saving agent) have been proposed, as described in U.S. Pat. Nos. 5,496,695, 5,545,505, 5,545,507, 5,637,449, 5,645,130, 5,635,339, 5,545,515 and 5,686,228; JP-A Nos. 10-339929, 11-84576, 11-95365, 11-95366, 11-109546, 11-119372, 11-119373, 2000-356834, and 2001-27790 (hereinafter, the term, JP-A is referred to as an unexamined, published Japanese Patent Application).

However, problems arose with a photothermographic material with built-in silver saving agents that the density in unexposed area varied depending on aging conditions of the photothermographic before being processed and an intended density was not obtained. Furthermore, compounds described in the foregoing patents, which easily increase image contrast are advantageous for images requiring high contrast but are not always advantageous for the use requiring delicate gradation, such as clinical photography.

There were also proposed photothermographic materials containing a silane coupling agent, such as silane alkoxide compounds in the image forming layer or protective layer, as described in U.S. Pat. Nos. 4,741,992, 4,886,739, 5,264,334 and 5,294,526. However, such a silane coupling agent described therein were incorporated for the purpose of enhancing adhesion to the protective layer, not for silver-saving.

SUMMARY OF THE INVENTION

In view of the foregoing, the present invention was achieved. Thus, it is an object of the invention to provide a photothermographic material containing a novel silver-saving agent, leading to superior gradation, relatively high maximum density and low fogging density, prevention of occurrence of interference fringes and improved stability in coating solution and raw stock stability, and a suitable image recording method by the use thereof.

The object described above can be accomplished by the following constitution:

A photothermographic material comprising a support having thereon an image forming layer containing an organic silver salt, photosensitive silver halide and a reducing agent, the photothermographic material further having a protective layer on the image forming layer and optionally an interlayer between the support and the image forming layer, wherein at least one of the image forming layer and the interlayer contains an alkoxy-silane compound having at least two primary or secondary amino groups or a salt thereof, or a Schiff base formed through dehydration condensation of an alkoxy-silane compound having at least one primary amino group and a ketone compound.

1. A photothermographic material comprising a support having thereon an image forming layer comprising an organic silver salt, photosensitive silver halide and a reducing agent and further thereon a protective layer, wherein the image forming layer contains an alkoxy-silane compound having at least two primary or secondary amino groups or a salt of thereof;

2. A photothermographic material comprising a support having thereon an image forming layer comprising an organic silver salt, photosensitive silver halide and a reducing agent and further thereon a protective layer, wherein the image forming layer comprises a Schiff base, which has been formed through dehydration condensation of an alkoxy-silane compound having at least one primary amino group and a ketone compound;

3. The photothermographic material described in 2. above, wherein the Schiff base has at least one secondary amino group within the molecule:

4. The photothermographic material described in any of 1. through 3. above, wherein the image forming layer comprises an isocyanate compound having at least two isocyanate groups within the molecule;

5. A photothermographic material comprising a support having thereon an interlayer, an image forming layer comprising an organic silver salt, photosensitive silver halide and a reducing agent, and a protective layer in this order, wherein the interlayer comprises an alkoxy-silane compound having at least two primary or secondary amino groups or its salt;

6. A photothermographic material comprising a support having thereon an interlayer, an image forming layer comprising an organic silver salt, photosensitive silver halide and a reducing agent, and a protective layer in this order, wherein the interlayer comprises a Schiff base, which has been formed through dehydration condensation of an alkoxy-silane compound having at least one primary amino group and a ketone compound;

7. The photothermographic material described in 6. above, wherein the Schiff base has at least one secondary amino group within the molecule;

8. The photothermographic material described in any of 5. through 7 above, wherein the image forming layer contains an isocyanate compound having at least two isocyanate groups within the molecule;

9. The photothermographic material described in any of 1. through 8. above, wherein the image forming layer comprises an acid anhydride;

10. An image recording method, wherein when recording an image on the photothermographic material as claimed in any of 1 through 9, exposure is conducted at an angle between the surface to be exposed and a laser beam of being substantially not vertical;

11. An image recording method, wherein when recording an image on the photothermographic material as claimed in any of 1 through 9, exposure is conducted using a laser light scanning exposure machine of longitudinal multiple laser scanning light;

12. An image recording method, wherein when recording an image on the photothermographic material as claimed in any of 1 through 9, scanning exposure is conducted using at least two laser beams;

13. The image recording method as described in any of 10 through 12, the scanning exposure is conducted using a laser at a wavelength of 700 to 1200 nm.

DETAILED DESCRIPTION OF THE INVENTION

As a result of study of the inventors of this invention, it was found that incorporation an alkoxy-silane compound into image forming layer or interlayer of a photothermographic material enabled to save silver, leading to little variation in sensitivity at a relatively low fogging level, irrespective of storage conditions prior to thermal development and resulting in images with not so high contrast.

Next, photothermographic materials relating to the invention will be described. In one embodiment of the invention, the image forming layer contains an alkoxy-silane compound having at least two primary or secondary amino groups or a salt of the alkoxy-silane compound. The expression, having at least two primary or secondary amino groups refers to having at least two primary amino groups, having at least two secondary amino groups, or having at least one primary amino group and at least one secondary amino group. The salt of the alkoxy-silane compound refers to an adduct of the alkoxy silane compound with an organic or inorganic acid capable of forming an onium salt with an amino group. Examples of such alkoxy-silane compound or a salt thereof are shown below but are not limited to these, including any alkoxy-silane compound having at least two primary or secondary amino groups or salt thereof.

A-1

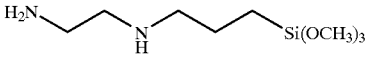

A-2

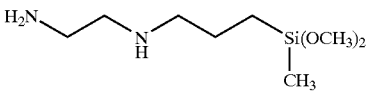

A-3

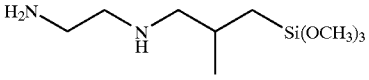

A-4

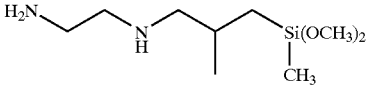

A-5

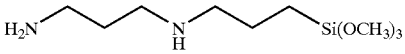

-continued

A-6

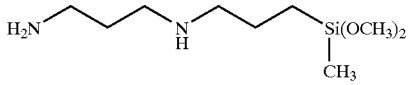

A-7

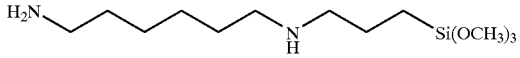

A-8

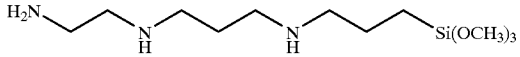

A-9

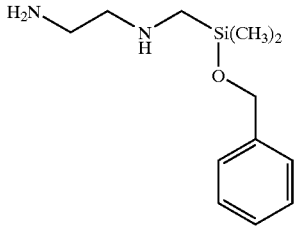

A-10

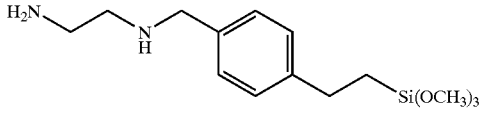

A-11

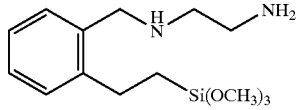

A-12

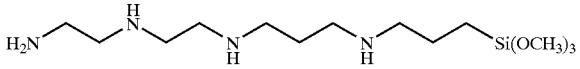

A-13

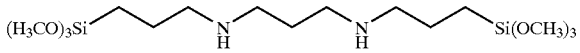

A-14

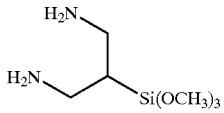

A-15

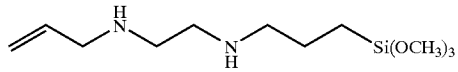

A-16

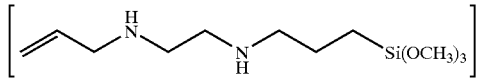

HCl

A-17

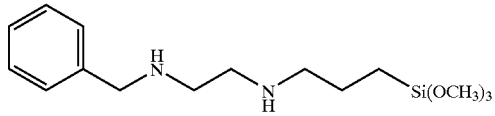

A-18

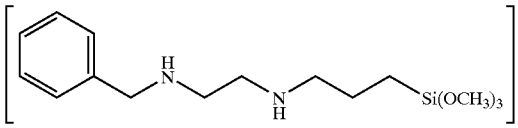

HCl

-continued

A-19

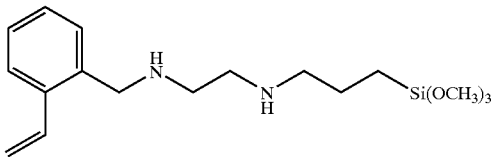

A-20

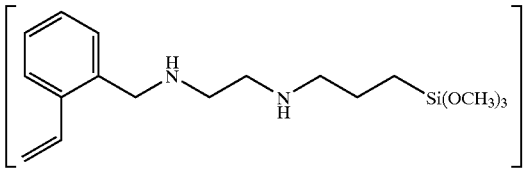

A-21

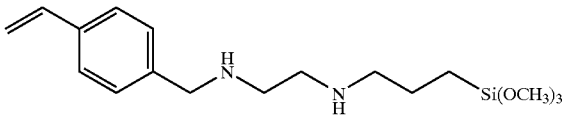

A-22

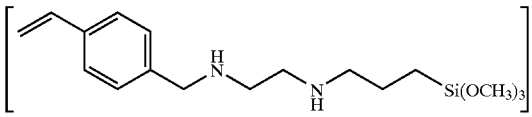

A-23

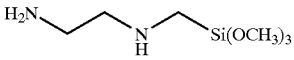

A-24

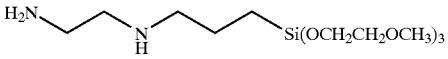

A-25

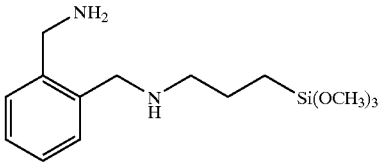

A-26

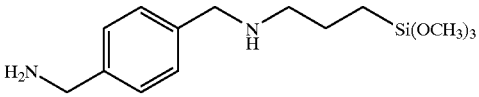

A-27

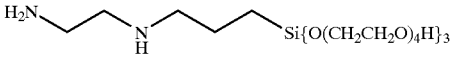

A-28

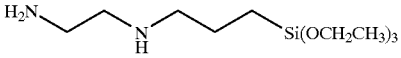

A-29

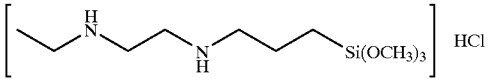

A-30

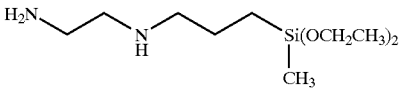

A-31

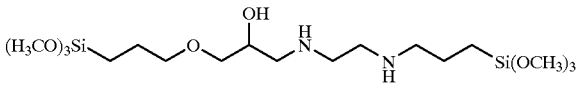

-continued

A-32

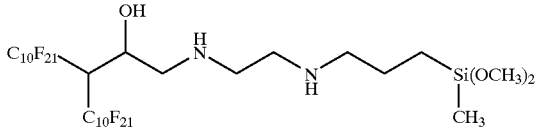

A-33

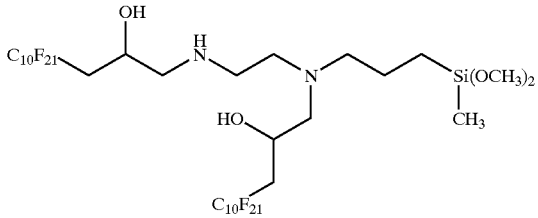

In these compounds of the invention, the alkoxy group forming an alkoxysilyl is preferably a alkoxy group comprised of a saturated hydrocarbon, and more preferably methoxy, ethoxy or isopropoxy group in terms of superior storage stability. Further, a compound having no unsaturated hydrocarbon group within the molecule is preferable minimize variation in sensitivity, caused by storage conditions prior to thermal development. The alkoxy-silane compound or its sals may be used alone or in combination.

In the second embodiment of the invention, the image forming layer contains a Schiff base, which is formed through dehydration condensation of an alkoxy-silane compound having at least one primary amino group and a ketone compound, i.e., the Schiff base, which is formed as a condensation product of the alkoxy-silane compound and a ketone compound. The use of such a Schiff base enables to save silver, minimizing variation in sensitivity at a relatively low fogging level and resulting images with not so high contrast. Furthermore, as the primary amine moiety was previously blocked, in cases when using a ketone type solvents in the preparation of a coating solution for the image forming layer, variation in sensitivity with aging after preparation og the coating solution can be prevented. The ketone compounds used to form a Schiff base with the alkoxy-silane compound according to the invention are not specifically limited but those having a boiling point of not more than 150° C., more preferably not more than 100° C. are preferable in terms of odor caused in the image forming process described later.

Examples of such a Schiff base are shown below but are by no means limited to these, including any Schiff base formed of condensation of an alkoxy-silane compound having at least one primary amino group and a ketone compound.

S-1

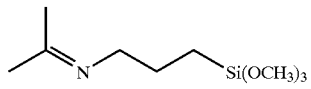

S-2

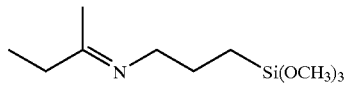

S-3

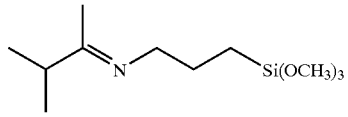

-continued

S-4

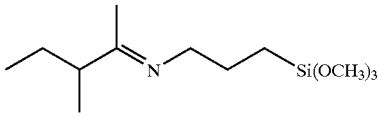

S-5

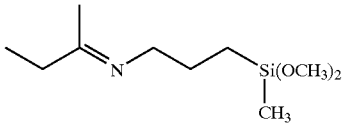

S-6

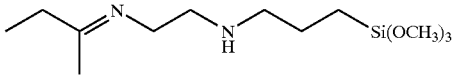

S-7

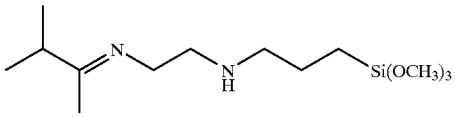

S-8

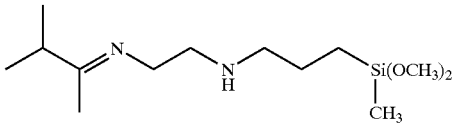

S-9

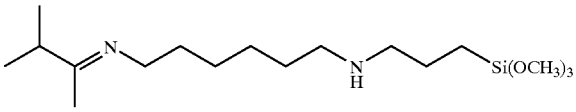

S-10

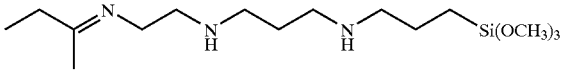

S-11

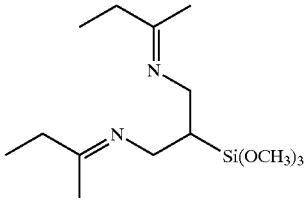

S-12

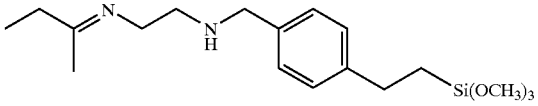

S-13

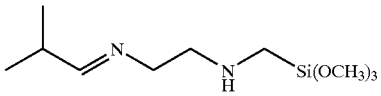

S-14

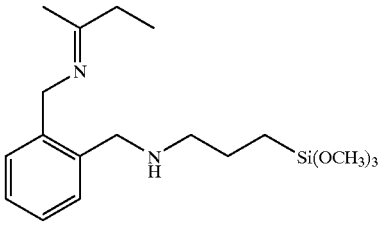

-continued

S-15

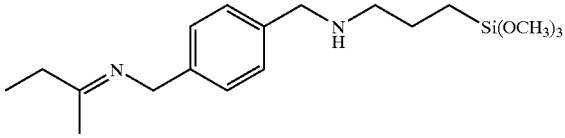

S-16

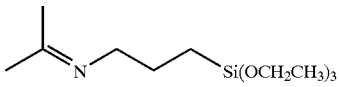

S-17

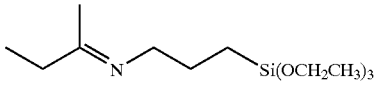

S-18

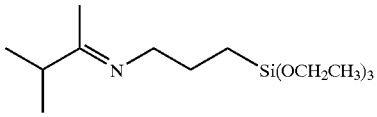

S-19

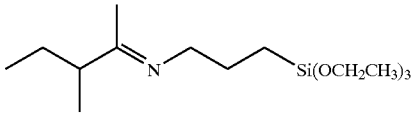

S-20

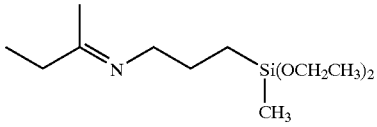

S-21

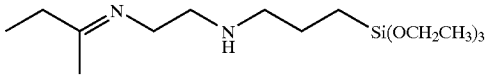

S-22

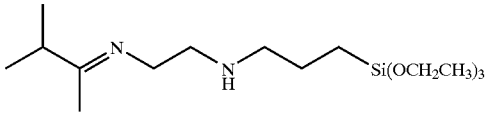

S-23

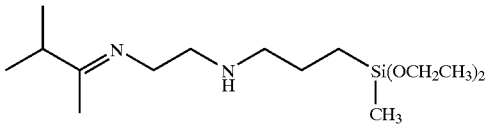

S-24

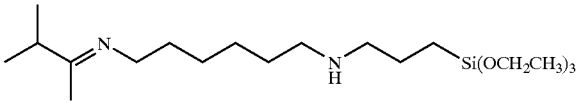

S-25

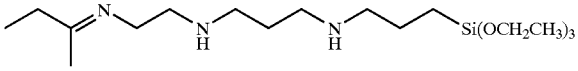

Of the foregoing compounds, a Schiff base having at least one secondary amino group within the molecule is preferred for the purpose of achieving the silver-saving. The foregoing Schiff base compounds may be used alone or in combination thereof.

In the foregoing embodiments of the invention, the alkoxy-silane compound or its salt, or Schiff base is incorporated into the image forming layer, preferably in an amount of 0.00001 to 0.05 mol per mol of silver. Incorporation of both of the alkoxy-silane compound or its salt and the Schiff base is also included in the scope of the invention. However, excessive incorporation of the alkoxy-silane compound or Schiff base often increase densities in unexposed areas in the imaging process described later. To reduce dependence of the addition amount of the alkoxy-silane compound or Schiff base, it is preferred to incorporate an isocyanate compound, which has at least two isocyanate groups within the molecule, into the image forming layer.

Such isocyanate isocyanate compounds are not specifically limited and examples thereof include aliphatic isocyanates, alicyclic isocyanates, benzeneisocyanates, naphthalenediisocyanates, biphenyldiisocyanates, diphenylmethandiisocyanates, triphenylmethanediisocyanates, triisocyanates, tetraisocyanates, their adducts and adducts of these isocyanates and bivalent or trivalent polyhydric alcohols. Exemplary examples include ethanediisocyanate, butanediisocyanate, hexanediisocyanate, 2,2-dimetylpentanediisocyanate, 2,2,4-trimethylpentanediisocyanate, decanediisocyanate, ω,ω'-diisocyanate-1,3-dimethylbenzol, ω,ω'-diisocyanate-1,2-dimethylcylclohexanediisocyanate, ω,ω'-diisocyanate-1,4-diethylbenzol, ω,ω'-diisocyanate-1,5-dimethylnaphthalene, ω,ω'-diisocyanate-n-propypbiphenyl, 1,3-phenylenediisocyanate, 1-methylbenzol-2,4-diisocyanate, 1,3-dimethylbenzol-2,6-diisocyanate, naphthalene-1,4-diisocyanate, 1,1'-naphthyl-2,2'-diisocyanate, biphenyl-2,4'-diisocyanate, 3,3'-dimethylbiphenyl-4,4'-diisocyanate, diphenylmethane-4,4'-diisocyanate, 2,2'-dimethyldiphenylmethane-4,4'-diisocyanate, 3,3'-dimethoxydiphenylmethane-4,4'-diisocyanate, 4,4'-diethoxydiphenylmethane-4,4'-diisocyanate, 1-methylbenzol-2,4,6-triisocyanate, 1,3,5-trimethylbenzene-2,4,6-triisocyanate, diphenylmethane-2,4,4'-triisocyanate, triphenylmethane-4,4',4'-triisocyanate, tolylenediisocyanate, 1,5-naphthylenediisocyanate; dimmer or trimer adducts of these isocyanate compounds (e.g., adduct of 2-mole hexamethylenediisocyanate, adduct of 3 mole hexamethylenediisicyanate, adduct of 2 mole 2,4-tolylenediisocyanate, adduct of 3 mole 2,4-tolylenediisocyanate); adducts of two different isocyanates selected from these isocyanate compounds described above; and adducts of these isocyanate compounds and bivalent or trivalent polyhydric alcohol (preferably having up to 20 carbon atoms, such as ethylene glycol, propylene glycol, pinacol, and trimethylol propane), such as adduct of tolylenediisocyanate and trimethylolpropane, or adduct of hexamethylenediisocyanate and trimethylolpropane. These isocyanate compounds may be used singly or in their combination. The foregoing isocyanate compound is incorporated preferably in an amount of 0.01 to 0.20 mol per mol of silver.

Problems occasionally arose with incorporation of the silver-saving agent into photothermographic materials that variation of fogging or sensitivity was easily caused by temperature fluctuation or rate variation during thermal development. In the invention, it is preferred to incorporate an acid anhydride into the image forming layer to improve such variation. Examples of such an acid anhydride include aromatic acid anhydrides, such as phthalic acid anhydride, 2,3-benzophenone-dicarboxylic acid anhydride, 3,4-benzophenone-dicarboxylic acid anhydride, 2,3-dicarboxypheny phenyl ether anhydride, 3,4-dicarboxyphenyl phenyl ether anhydride, 3,4-biphenyldicarboxylic acid anhydride, 2,3-dicarboxyphenylphenylsulfonic acid anhydride, 2,3-dicarboxyphenylphenylsulfonic acid anhydride, 3,4-dicarboxyphenylphenylsulfonic acid anhydride, 2,3-dicarboxyphenylphenylsulfide anhydride, 1,2naphthalene-dicarboxylic acid anhydride, 1,2-naphthalene-dicarboxylic acid anhydride, 2,3-naphthalene-dicarboxylic acid anhydride, 1,8-naphthalene-dicarboxylic acid anhydride, 1,2-anthracene-dicarboxylicid anhydride, 2,3-anthracene-dicarboxylic acid anhydride, 1,9-anthracene-dicarboxylic acid anhydride, 3,3',4,4'-biphenyltetracarboxylic acid anhydride, 2,2',3,3'-biphenyl^tetracarboxylic acid anhydride, bis(3,4-dicarboxyphenyl)methane di-anhydride, bis(2,3-dicarboxyphenyl)methane di-anhydride, bis(3,4-dicarboxyphenyl)sulfon di-anhydride, 1,1-bis(2,3-dicarboxyphenyl)ethane di-anhydride, 2,2-bis(3,4-dicarboxyphenyl)propane di-anhydride, 2,2-bis(2,3-dicarboxyphenyl)propane di-anhydride, 4,4'-(m-phenylewnedioxy)diphthalic acid di-anhydride, 2,3,6,7-naphthalene-tetracarboxylic acid di-anhydride, 1,4,5,8-naphthalene-tetracarboxylic acid di-anhydride, 1,2,5,6-naphthalene-tetracarboxylic acid di-anhydride, 1,2,3,4-benzene-tetracarboxylic acid di-anhydride, 3,4,9,10-perylene-tetracarboxylic acid di-anhydride, 2,3,6,7-anthracene-tetracarboxylic acid di-anhydride, and 1,2,7,8-phenathlene-tetracarboxylic acid di-anhydride; and aliphatic acid anhydrides, such as succinic acid anhydride, glutaric acid anhydride, 1,2-cyclopentane-dicarboxylic acid anhydride, 1,2-cyclohexane-dicarboxylic acid anhydride, 1-cyclohexene-1,2-dicarboxylic acid anhydride, 4-cyclohexene-1,2-dicarboxylic acid anhydride, 1-cyclopentene-1,2-dicarboxylic acid anhydride, 5-norbonene-endo-2,3-dicarboxylic acid anhydride, 3,6-epoxy-4-cyclohexene-1,2-dicarboxylic acid anhydride, bicyclo[2.2.2]octa-7-ene-2,3,5,6-tetracarboxylic acid di-anhydride, ethylenetetracarboxylic acid di-anhydride, butane-tetracarboxylic acid di-anhydride, and cyclopentane-tetracarboxylic acid di-anhydride.

Of the foregoing acid anhydrides, aliphatic acid anhydrides are preferred and cyclic saturated hydrocarbon type acid anhydrides are more preferred. These acid anhydrides are used alone or in combination thereof. The amount of the acid anhydride added is usually 0.001 to 0.20 mol per mol of silver.

Next, a support, organic silver salt, photosensitive silver halide and reducing agent will be described.

Examples of synthetic resin forming a support used in photothermographic materials include acryl type resin, polyester, polycarbonate, polyalylate, poly(vinyl chloride), polyethylene, polystyrene, nylon, aromatic polyamide, poly (ether ether ketone), polystyrene, polyethersulfone, polyimide, polyetherimide, and triacetyl cellulose. There are also employed resin films comprised of two or more layers of the foregoing resin(s).

In the image recording process relating to the invention, after latent image formation, thermal development is conducted to form images, so that a support, which has been stretched in the form of film, followed by being subjected to annealing is preferable in terms of dimensional stability. Of the resins described above, polyester, polycarbonate, polyalylate, poly(ether ether ketone) and triacetyl cellulose are preferred and polyester that has been subjected to bi-axial stretching and annealing is specifically preferred in terms of general purpose and cost.

Polyester will be further detailed. The polyester refers to a polymeric compound having a ester bonding in the main chain, which are obtained by condensation polymerization of a diol and dicarboxylic acid. Examples of the dicarboxylic acid include terephthalic acid, isophthalic acid, phthalic acid, naphthalene-dicarboxylic acid, adipinic acid, and sebacic acid. Examples of the diol include ethylene glycol, trimethylene glycol, tetramethlene glycol and cyclohexane dimethanol. In the invention are preferably employed polyethylene terephthalate (PET) and its copolymer, polybutylene naphthalate (PBN) and its copolymer, polybutylene terephthalate (PBT) and its copolymer, and polyethylene naphthalate (PEN) and its copolymer. In these polyesters, the numer of repeating units are preferably not less than 100, and more preferably not less than 150; the intrinsic viscosity is preferably not less than 0.6 dl/g and more preferably not less than 0.7 dl/g, thereby leading to superior film-making stability. Into these polyesters can be compounded commonly known additives such as a lubricant, stabilizer, antioxidant, viscosity-adjusting agent, antistatic agent, colorant and pigment. The thickness of the support is usually 50 to 500 μm, and preferably 100 to 250 μm.

In cases where the photothermographic material is used for clinical images, the foregoing supports may be blue-tinted. Usable dyes include, for example, a disperse dye, cationic dye, basic dye, acid dyereactive dye, direct dye, vat dye, azoic dye, mordant dye, acid mordant dye, union dye and solvent dye. Of these dyes, the solvent dye is preferable in terms of uniform dispersity at the stage of melt kneading in the manufacturing process of supports and dye solubility at the time of preparing a coating solution for a backing layer. Heat resistance is preferably 250° C. or higher, in which no sublimation occurs at the time of melt kneading and deterioration of the dye during kneading is reduced. Specifically, in cases when the temperature of a extrusion machine is needed to be raised to 300° C. to extrude resin for use in supports, the heat resistance is preferably 280° C. or higher. Dyes having λmax at 600 to 650 nm is preferable for blue-tinting.

On the opposite side of the support to the image forming layer, a backing layer may be provided for the purpose of transportability, antistatic property and antihalation. The backing layer is comprised of a binder resin and optionally of various additives. As binder resin forming the backing layer are optionally employed commonly known transparent or translucent resins, including, for example, poly(vinyl acetal) type resin such as poly(vinyl formal), poly(vinyl acetoacetal), and poly(vinyl butyral cellulose) type resin such as nitrocellulose, and cellulose acetate bytyrate; styrene type resin such as polystyrene, copolymer of styrene and acrylonitrile, and copolymer of styrene, acrylonitrile and acryly rubber; acryl type resin such as polymethyl methacrylate; polyester, polyurethane, polalylate, epoxy resin and phenoxy resin. Furthermore, an epoxy group containing compound and acryl group containing compound that are actinic ray-hardenable may also employed as a layer forming resin. These binder resins may be used alone or in combination thereof. Specifically, hydroxy group-containing resin may be cross-linked with cross-linking agents such as a poly-functional isocyanate compound or a metal alkoxide such as alkoxy-silane compound or alkoxy-titanium compound, which contains plural metal alkoxide moieties.

There may be incorporated a filler to prevent troubles in pick-up or maintain transportability, in an amount of 0.05 to 30% by weight, based on the backing layer. A lubricant or a antistatic may be incorporated in the backing layer to improve lubrication property and antistatic property. Examples of the lubricant include a fatty acid, fatty acid ester, fatty acid amide, polyoxyethylene, polyoxypropylene, (modified) silicone oil, (modified) silicone resin, (modified) fluorinated compound, (modified) fluorinated resin, fluorinated resin, fluorocarbon, and wax. Examples of antistatic include a cationic surfactant, anionic surfactant, nonionic surfactant, polymeric antistatic agent, metal oxide and conductive polymer, compounds described in "11290 no Kagaku-shohin" (11290 Chemical Goods), published by Kagakukogyo-Nippo-Sha at page 875 to 876, and compounds described in U.S. Pat. No. 5,244,773, col. 14 to 20. A compound having absorption with the oscillation wavelength region of laser used in the image recording process relating to the invention, as described later may be incorporated as an antihalation agent. The backing layer thickness is usually 0.5 to 25 μm, and preferably 1.0 to 15 μm. The backing layer may be comprised of single layer or plural layers. Furthermore, an antistatic layer may be interposed between the backing layer and the support to enhance antistatic property and the support surface of the backing layer side may be subjected to corona discharge, plasma discharge or anchor coat treatment to enhance adhesion property or coating property of the backing layer.

Nex, photosensitive silver halide, organic silver salt and reducing agent will be described.

In order to minimize cloudiness after image formation and to obtain excellent image quality, the less the average grain size, the more preferred, and the average grain size is preferably not more than 0.1 μm, more preferably between 0.01 and 0.1 μm, and still more preferably between 0.02 and 0.08 μm. The grain size as described herein is defined as a diameter of a circle having the same area as a grain observed with an electron microscope (i.e., equivalent circle diameter). Furthermore, silver halide grains are preferably monodisperse grains. The monodisperse grains as described herein refer to grains having a coefficient of variation of grain size obtained by the formula described below of not more than 40%; more preferably not more than 30%, still more preferably not more than 3%, and most preferably not more than 20%.

Degree of monodisperse (%)=(standard deviation of grain diameter/average grain diameter)×100(%)

The shape of the silver halide grains is not specifically limited, but in cases when using a sensitizing dye selectively adsorbing onto the crystal face of a Miller index of [100], for example, a high ratio accounted for by a Miller index [100] face is preferred. This ratio is preferably at least 50%; is more preferably at least 70%, and is most preferably at least 80%. The ratio accounted for by the Miller index [100] face can be obtained based on T. Tani, J. Imaging Sci., 29, 165 (1985) in which adsorption dependency of a [111] face or a [100] face is utilized.

Another preferred shape of silver halide grains is a tabular grain. Herein, the tabular grain refers to grain having an aspect ratio (r/h) of 3 or more, in which "r" is a root square of the grain projected area (expressed in μm) and "h" is a thickness in the direction thereto. Specifically, the aspect ration is preferably 3 to 50. The grain thickness is preferably not more than 0.1 μm, and more preferably 0.01 to 0.08 μm. The tabular grains, which are detailed in U.S. Pat. Nos. 5,264,337, 5,314,798 and 5,320,958 can readily be prepared.

The halide composition of silver halide is not specifically limited and may be any one of silver chloride, silver chlorobromide, silver iodochlorobromide, silver bromide, silver iodobromide and silver iodide. The silver halide grains used in the invention can be prepared according to the methods described in P. Glafkides, Chimie Physique Photographique (published by Paul Montel Corp., 19679; G. F.

Duffin, Photographic Emulsion Chemistry (published by Focal Press, 1966); V. L. Zelikman et al., Making and Coating of Photographic Emulsion (published by Focal Press, 1964).

Silver halide used in the invention preferably occludes ions of metals belonging to Groups 6 to 11 of the Periodic Table. Preferred as the metals are W, Fe, Co, Ni, Cu, Ru, Rh, Pd, Re, Os, Ir, Pt and Au. These metals may be introduced into silver halide in the form of a complex. In the invention, six-coordinate complexes represented by the general formula described below are preferred:

Formula: $(ML_6)^m$:

wherein M represents a transition metal selected from elements in Groups 6 to 11 of the Periodic Table; L represents a coordinating ligand; and m represents 0, 1-, 2-, 3- or 4-. Exemplary examples of the ligand represented by L include halides (fluoride, chloride, bromide, and iodide), cyanide, cyanato, thiocyanato, selenocyanato, tellurocyanato, azido and aquo, nitrosyl, thionitrosyl, etc., of which aquo, nitrosyl and thionitrosyl are preferred. When the aquo ligand is present, one or two ligands are preferably coordinated. L may be the same or different.

M is preferably rhodium (Rh), ruthenium (Ru), rhenium (Re), iridium (Ir) or osmium (Os). Exemplary examples of transition metal ligand complexes include $[RhCl_6]^{3-}$, $[RuCl_6]^{3-}$, $[ReCl_6]^{3-}$, $[RuBr_6]^{3-}$, $[OSCl_6]^{3-}$, $[CrCl_6]^{4-}$, $[IrCl_6]^{4-}$, $[IrCl_6]^{3-}$, $[Ru(NO)Cl_5]^{2-}$, $[RuBr_4(H_2O)]^{2-}$, $[Ru(NO)(H_2O)Cl_4]^{-}$, $[RhCl_5(H_2O)]^{2-}$, $[Re(NO)Cl_5]^{2-}$, $[Re(NO)(CN)_5]^{2-}$, $[Re(NO)Cl(CN)_4]^{2-}$, $[Rh(NO)_2Cl_4]^{-}$, $[Rh(NO)(H_2O)Cl_4]^{-}$, $[Ru(NO)(CN)_5]^{2-}$, $[Fe(CN)_6]^{3-}$, $[Rh(NS)Cl_5]^{2-}$, $[Os(NO)Cl_5]^{2-}$, $[Cr(NO)Cl_5]^{2-}$, $[Re(NO)Cl_5]^{-}$, $[Os(NS)Cl_4(TeCN)]^{2-}$, $[Ru(NS)Cl_5]^{2-}$, $[Re(NS)Cl_4(SeCN)]^{2-}$, $[Os(NS)Cl(SCN)_4]^{2-}$, $[Ir(NO)Cl_5]^{2-}$ and $[Ir(NS)Cl_5]^{2-}$.

The foregoing metal ions, metal complexes and metal complex ions may be used alone or in combination of identical or different kinds of metals. The content of the metal ion, metal complex or metal complex ion is usually $1\times10^{-9}$ to $1\times10^{-2}$ mol, and preferably $1\times10^{-8}$ to $1\times10^{-4}$ mol per mol silver halide.

Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation. These compounds may be added several times by dividing the added amount. Uniform content in the interior of a silver halide grain can be carried out. As disclosed in JP-A No. 63-29603, 2-306236, 3-167545, 4-76534, 6-110146, 5-273683, the metal can be distributively occluded in the interior of the grain.

These metal compounds can be dissolved in water or a suitable organic solvent (for example, alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening.

Silver halide grain emulsions used in the invention may be desalted after the grain formation, using the methods known in the art, such as the noodle washing method, flocculation process, ultrafiltration and electrolysis.

Silver halide grains used in the invention are preferably subjected to chemical sensitization. Preferred chemical sensitization include, for example, sulfur sensitization, selenium sensitization and tellurium sensitization. Further, noble metal sensitization using gold compound, platinum, palladium and iridium compounds, and reduction sensitization may also be employed.

In the sulfur sensitization, selenium sensitization and tellurium sensitization can be used compounds commonly known in the art, as described in, for example, JP-A 7-128768. Examples of tellurium sensitizers include diacyl telluride, bis(oxycarbonyl)telluride, bis(carbamoyl) telluride, bis(oxycarbonyl)ditelluride, bis(carbamoyl) ditelluride, P=Te bond-containing compound, tellurocarboxylic acids, Te-organyltellurocarboxylic acid esters, di(poly)tellurides, tellurides, tellurol, telluroacetals, tellurosulfonates, P–Te bpnd-containing compound, Te-containing heterocyclic compounds, tellurocarbonyl compounds, inorganic tellurium compounds and colloidal tellurium. Examples of the compounds used in the noble metal sensitization include chloroauric acid, potassium chloroaurate, potassium aurothiocyanate, gold sulfide, gold selenide, compounds described U.S. Pat. No. 2,448,060 and British Patent No. 618,061. Examples of the compounds used in the reduction sensitization include ascorbic acid, thiourea dioxide, stannous chloride, aminoiminomethanesulfinic acid, hydrazine derivatives, borane compounds, silane compounds and polyamine compounds. The reduction sensitization can be carried out by ripening an emulsion with keeping the pH and pAg at not less than 7 and not more than 8.3, respectively. Reduction sensitization can also achieved by introducing single addition of silver ions during grain formation.

Organic silver salts contained in the image forming layer relating to the invention are a reducible silver source and an organic acid salt containing a reducible silver ions. Examples of organic acids usable in the invention include aliphatic carboxylic acids, carbocyclic carboxylic acids, heterocyclic carboxylic acids and heterocyclic compounds. Specifically, long chain aliphatic carboxylic acids (having 10 to 30 carbon atoms and preferably 15 to 25 carbon atoms) and heterocyclic carboxylic acids containing heterocyclic ring are preferred. Furthermore, organic silver salt complexes, which contain a ligand having a total stability constant of 4.0 to 10.0 with respect to a silver ion, are also usable. Examples of such organic acid silver salts are described in Research Disclosure (hereinafter, also denoted as "RD") 17029 and 29963. Of these, silver salts of fatty acids are preferred and silver behenate, silver arachidate and silver stearate are specifically preferred.

The organic silver salt compound can be obtained by mixing an aqueous-soluble silver compound with a compound capable of forming a complex. Normal precipitation, reverse precipitation, double jet precipitation and controlled double jet precipitation, as described in JP-A 9-127643 are preferably employed.

In the invention, an average grain size of organic silver salts is preferably not more than 1 μm and monodisperse. The grain size of organic silver salts is referred to as a diameter of a sphere having the same volume as an organic silver salt grain, in cases where the organic silver salt grain is spherical, needle-like or tabular form. The average grain size is preferably 0.01 to 0.8 μm, and more preferably 0.05 to 0.5 μm. The expression, monodisperse is the same as defined in the case of silver halide, and a degree of grain dispersity (that is, a degree of homogeneity of grain size distribution) is preferably 1 to 30%. In the invention, the organic silver salt is preferably monodisperse grains having an average size of not more than 1, thereby leading to higher image density. At least 60% of the organic silver salt is preferably accounted for by tabular grains. The tabular grains of the organic silver salt is the same as defined in silver halide described earlier and refers to those which have an aspect ratio of 3 or more.

Organic silver salt grains used in the invention are preliminarily dispersed together with a binder or surfactant and then pulverized using a media dispersing machine or high-pressure homogenizer. In the preliminary dispersion can be used an anchor-type or propeller-type stirrer commonly known, a high-speed rotating centrifugal stirrer (dissolver), and a high-speed rotating shearing-type stirrer (homomixer). As the foregoing media dispersing machine, a convolution mill such as ball mill, planet mill and vibration mill, beads mill as a medium-stirring mill. atreiter and basket mill can be used and as a high-pressure homogenizer, various types thereof can be used, including a type of colliding with wall or plug, a type of dividing liquid into plurality, followed by colliding with each other at a high-speed and a type of allowing to pass through a fine orifice. In apparatuses used to disperse organic silver salt grains, ceramics such as zirconia, alumina and silicon nitride or diamond are preferably used as material of a member in contact with the organic silver salt grains.

Organic silver salt grains used in the invention preferably contain Zr in an amount of 0.01 to 0.5 mg, and more preferably 0.01 to 0.3 mg per g of silver. In the foregoing dispersion procedure, optimization of a binder concentration, preliminary dispersion, operation condition of a dispersing machine and dispersing frequency are preferable as means for obtaining the organic silver salt grains of the invention.

As reducing agents contained in the image forming layer of the invention, commonly known compounds are employed, including, for example, phenols, polyphenols having two or more hydroxy groups, naphthols, bisnaphthols, polyhydroxybenzenes having two or more hydroxy groups, ascorbic acids, 3-pyrazolidones, pyrazoline-5-ones, pyrazolines, phenylenediamines, hydroxyamines, hydroquinone monoethers, hydroxamic acids, hydrazides, amidoximes and N-hydroxyureas. Of the foregoing reducing agents, preferred reducing agents used together with aliphatic carboxylic acid silver salts as an organic silver salt include, for example, polyphenols in which two or more phenols are linked with an alkylene linkage group or sulfur, specifically polyphenols, in which two or more phenol moieties are substituted, at least one position adjacent to the phenolic hydroxy group, by an alkyl group (e.g., methyl, ethyl, propyl, t-butyl, cyclohexyl) or an acyl group (e.g., acetyl, propionyl) and linked with an alkylene group or sulfur, such as 1,1-bis(2-hydroxy-3,5-dimethylphenyl)-3,5,5-trimethylhexane, 1,1-bis(2-hydroxy-3-t-butyl-5-methylphenyl)methane, 1,1-bis(2-hydroxy-3,5-di-t-butylphenyl)methane, (2-hydroxy-3-t-butyl-5-methylphenyl)-(2-hydroxy-5-methylphenyl)methane, 6,6'-benzilidene-bis(2,4-di-t-butylphenol), 6,6-benzilidene-bis(2-t-butyl-4-methylphenol), 6,6'-benzilidene-bis(2,4-dimethylphenol), 1,1-bis(2-hydroxy-3,5-dimethylphenyl)-2-methylpropane, 1,1,5,5-tetrakis(2-hydroxy-3,5-dimethylphenyl)-2,4-ethylpentane, 2,2-bis(4-hydroxy-3,5-dimethylphenyl)propane, and 2,2-bis(4-hydroxy-3,5-di-t-butylphenyl)propane, as described in U.S. Pat. Nos. 3,589,903 and 4,021,249; British Patent No. 1,486,148; JP-A 51-51933, 50-36110, 50-116023, 52-84727, 2001-56527, and 2001-92075; JP-B No. 51-35727 (hereinafter, the term, JP-B means published Japanese Patent); bisnaphthols described in U.S. Pat. No. 3,672,904, such as 2,2'-dihydoxy-1,1'binaphthyl, 6,6'dibromo2,2'-dihydroxy-1,1'binaphthyl, 6,6'-dinitro-2,2'dihydroxy-11'-binaphthyl, bis(2-hydroxy-1-naphthyl)methane, 4,4'-dimethoxy-1,1'-dihydroxy-2,2'binaphthyl;sulfonamidophenols or sulfonamidonaphthols described in U.S. Pat. No. 3,801,321, such as 4-benzenesulfonamidophenol, 2-benzenesulfonamidophenol, 2,6-dichloro4-benzenesulfonamidophenol and 4-benzenesulfonamidonaphthol.

A content of the reducing agent in the image forming layer, is variable, depending of the kind of an organic silver salt or reducing agent and other constituents, and usually 0.05 to 10 mol, and preferably 0.1 to 3 mol per mol of organic silver salt. The foregoing reducing agents may be used in combination within the range of contents described above.

To hold essential constituents in the image forming layer are used binder resins. Such binder resins can optimally be selected from those used in the backing layer, as described earlier, within the range resulting no adverse effect on the object of the invention. However, it is required to disperse and hold the foregoing organic silver salt with the binder resin, so that resins containing a hydroxy or carboxyl group or its salt, sulfonic acid or its salt within the molecule are preferred. Preferred examples thereof include poly(vinyl acetal) type resin, cellulose type resin, phenoxy type resin, and functional group-introduced resins such as modified vinyl chloride resin, modified polyester, modified polyurethane, modified epoxy resin, and modified acryl type resin. These resins may be used alone or in combination thereof.

The image forming layer relating to the invention may optionally contain, in addition to the foregoing essential constituents, commonly known additives, such as an antifoggant, image toning agent, sensitizing dye, material exhibiting supersensitization (hereinafter, also denoted as supersensitizer) and a silver-saving agent. Examples of the antifoggant include compounds disclosed in JP-B No. 54-44212 and 51-9694, JP-A No. 55-140833 and U.S. Pat. Nos. 3,874,946 and 4,756,999; substituent-containing heterocyclic compound represented by formula of $—C(X_1)(X_2)(X_3)$, in which $X_1$ and $X_2$ represent a halogen atom and $X_3$ represents a hydrogen atom or halogen atom; and compounds disclosed in JP-A 9-288328 and 9-90550, U.S. Pat. No. 5,028,523, European Patent No. 600,587, 605,981 and 631,176. Furthermore, compounds described below may be used alone or in combination.
P-1
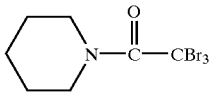
P-2
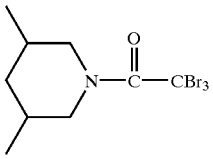
P-3
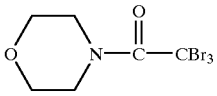
P-4
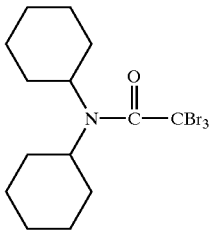
P-5
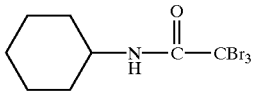
P-6
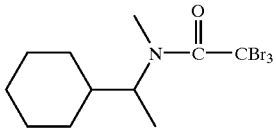
P-7
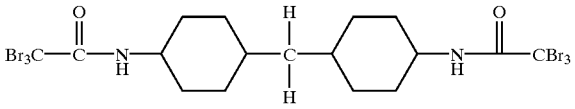
P-8
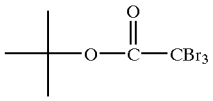
P-9
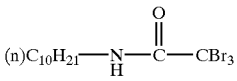
P-10
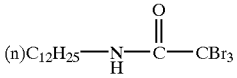
P-11
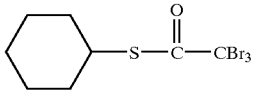
P-12
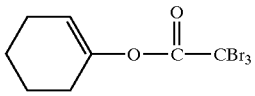
-continued
P-13
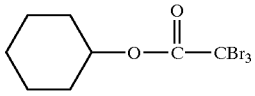
P-14
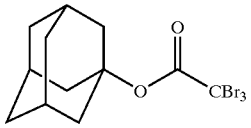
P-15
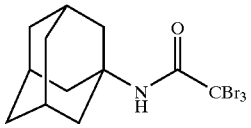
P-16
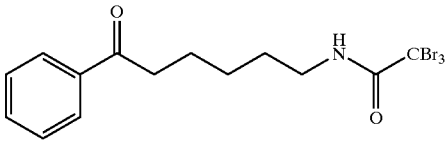
P-17
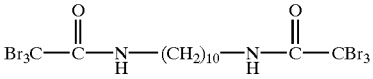
P-18
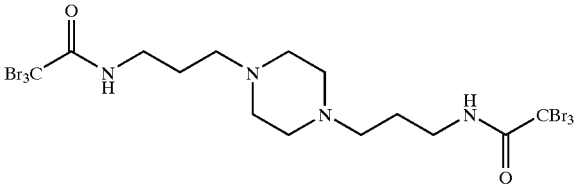
P-19
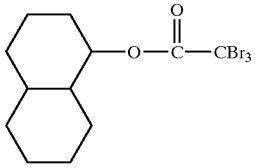
P-20
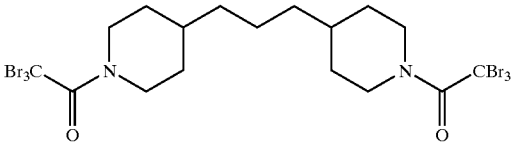
P-21
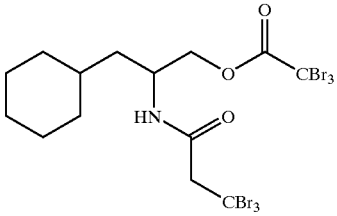

-continued

P-22

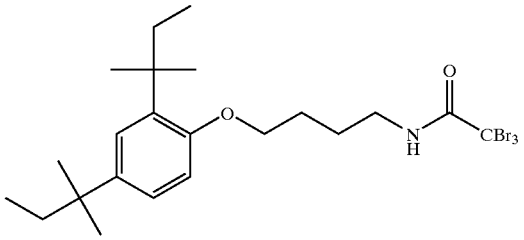

P-23

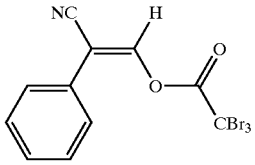

P-24

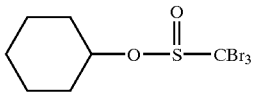

P-25

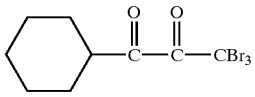

P-26

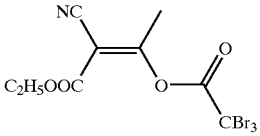

P-27

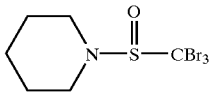

P-28

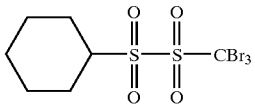

P-29

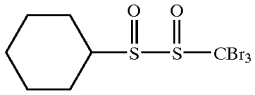

P-30

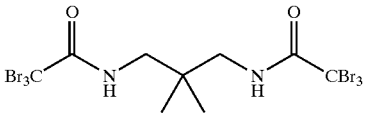

P-31

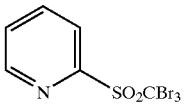

Image toning agents may be used to modify silver image tone. Examples thereof include imides (for example, phthalimide), cyclic imides, pyrazoline-5-one, and quinazolinone (for example, succinimide, 3-phenyl-2-pyrazoline-5-on, 1-phenylurazole, quinazoline and 2,4-thiazolidione); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides (for example, N-(dimethylaminomethyl)phthalimide); blocked pyrazoles, isothiuronium derivatives and combinations of certain types of light-bleaching agents (for example, combination of N,N'-hexamethylene(1-carbamoyl-3,5-dimethylpyrazole), 1,8-(3,6-dioxaoctane)bis-(isothiuroniumtrifluoroacetate), and 2-(tribromomethyl-sulfonyl)benzothiazole; merocyanine dyes (for example, 3-ethyl-5-((3-etyl-2-benzothiazolinylidene-(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone and benzenesulfinic acid sodium, or 8-methylphthalazinone and p-trisulfonic acid sodium); combinations of phthalazine and phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, naphthoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H,4H-2,3a,5,6a-tatraazapentalene). Preferred tone modifiers include phthalazone or phthalazine. The image toning agent may be incorporated into a protective layer, without adversely affecting the object of the invention.

As a sensitizing dye is used simple merocyanines described in JP-A No. 60-162247 and 2-48635, U.S. Pat. No. 2,161,331, West German Patent No. 936,071, and Japanese Patent Application No. 3-189532, used for an argon ion laser light source; trinuclear cyanines described in JP-A No. 50-62425, 54-18726 and 59-102229 and merocyanines described in Japanese Patent Application No. 6-103272, used for a helium neon laser light source; thiacarbocyanines described in JP=B No. 48-42172, 51-9609 and 55-39818, JP-A No. 62-284343 and 2-105135, used for LED and infrared semiconductor laser light source; tricarbocyanines described in JP-A 59-191032 and 60-80841 and dicarbocyanines having 4-quinoline nuclear described in JP-A No. 59-192242 and in general formulas (IIIa) and (IIIb) of JP-A No. 3-67242, used for infrared semiconductor laser light source. In response to the case where the wavelength of an infrared laser light source is 750 nm or more, and preferably 800 nm or more are preferably used sensitizing dyes described in JP-A No. 4-182639 and 5-341432, JP-B No. 6-52387 and 3-10931, U.S. Pat. No. 5,441,866, and JP-A No. 7-13295.

Useful sensitizing dyes, dye combinations exhibiting super-sensitization and materials exhibiting supersensitization are described in RD17643 (published in December, 1978), IV-J at page 23, JP-B 9-25500 and 43-4933 (herein, the term, JP-B means published Japanese Patent) and JP-A 59-19032, 59-192242 and 5-341432. In the invention, an aromatic heterocyclic mercapto compound represented by the following formula (M) and disulfide compound which is capable of forming the mercapto compound are preferred as a supersensitizer:

Ar—SM formula (M)

Ar—S—S—Ar Formula (Ma)

wherein M is a hydrogen atom or an alkali metal atom; Ar is an aromatic ring or condensed aromatic ring containing a nitrogen atom, oxygen atom, sulfur atom, selenium atom or tellurium atom.

The aromatic heterocyclic rings described above may be substituted with a halogen atom (e.g., Cl, Br, I), a hydroxy group, an amino group, a carboxy group, an alkyl group (having one or more carbon atoms, and preferably 1 to 4 carbon atoms) or an alkoxy group (having one or more carbon atoms, and preferably 1 to 4 carbon atoms).

Thiuronium compounds shown below are also a preferred supersensitizer to achieve enhanced sensitivity.

T-1

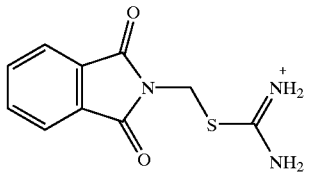

T-2

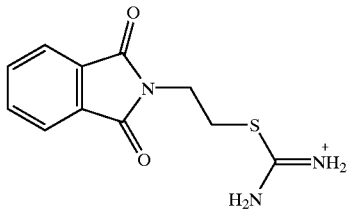

T-3

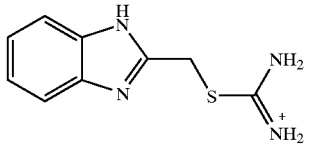

T-4

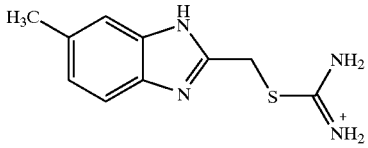

T-5

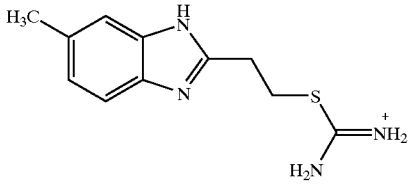

T-6

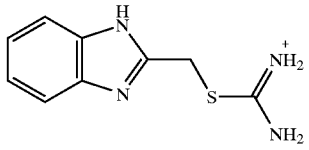

-continued

T-7

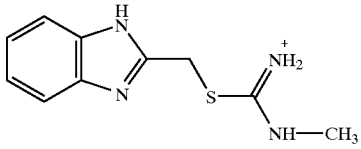

T-8

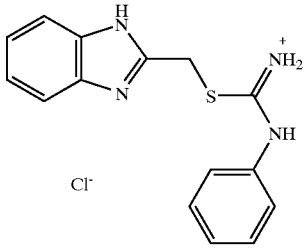

T-9

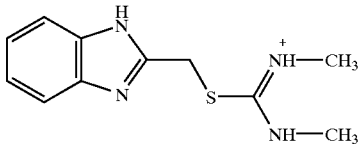

T-10

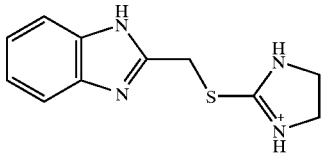

T-11

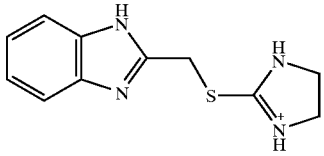

T-12

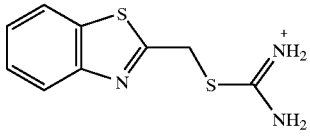

T-13

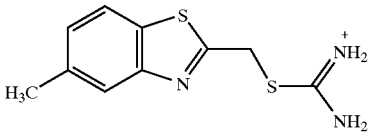

-continued

T-14

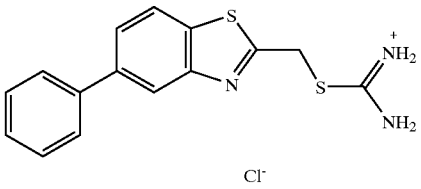

T-15

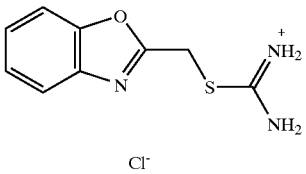

T-16

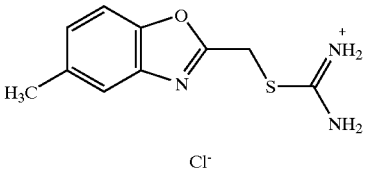

T-17

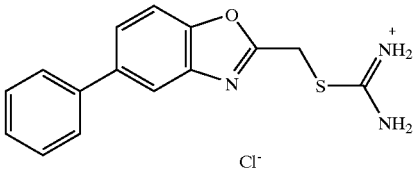

T-18

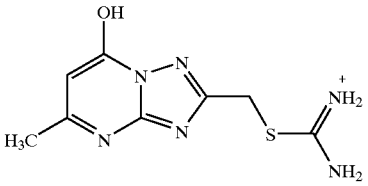

T-19

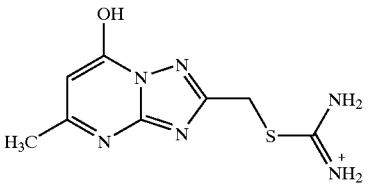

T-20

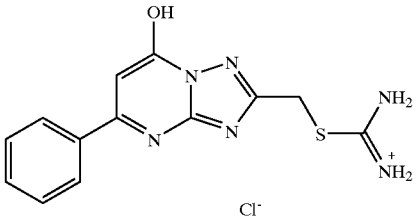

-continued

T-21

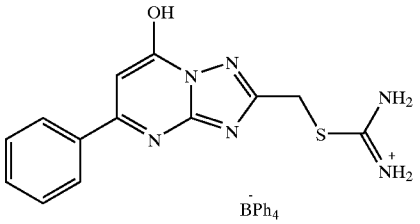

T-22

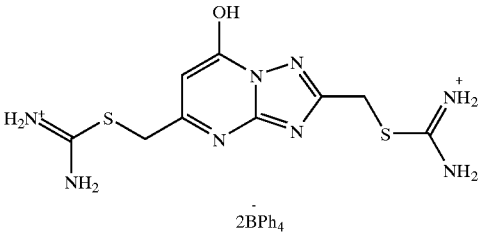

T-23

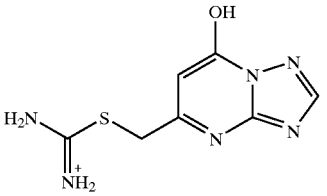

The foregoing supersensitizers are incorporated in the image forming layer containing an organic silver salt and silver halide grains, preferably in an amount of 0.001 to 1.0 mol, and more preferably 0.01 to 0.5 mol per mol of silver.

A macrocyclic compound containing a heteroatom may be incorporated in the image forming layer. Thus, macrocyclic compounds comprising a 9- or more-membered ring (more preferably 12- to 24-membered ring, and still more preferably 15- to 21-membered ring), containing at least one heteroatom selected from nitrogen, oxygen, sulfur and selenium are preferable. Representative compounds thereof include so-called crown ether compounds, which were synthesized for the first time by Pederson in 1967, and many of which were synthesized since then. These compounds are detailed in C. J. Pederson, Journal of American Chemical Society, vol. 86 (2495), 7017–7036 (1967); G. W. Gokel, S. H. Korzeniowski "Maclocyclic Polyether Synthesis", Springer-Vergal, (1982).

Commonly known silver-saving agents, other than the silver-saving agents relating to the invention may be incorporated in the image forming layer. Such compounds include, for example, those described in JP-A 11-95365, 11-133546 and 2000-112067, which are optionally selected and used. The silver saving agent is usually in an amount of $1\times10^{-6}$ to 1 mol, and preferably $1\times10^{-5}$ to $5\times10^{-1}$ mol per mol of silver.

In addition to the foregoing additives may be incorporated a surfactant, antioxidant, stabilizer, plasticizer, UV absorber and coating aid. These additives are optionally selected from compounds described in RD Item 17029 (June, 1978, page 9–15).

The image forming layer relating to the invention may be comprised of a single layer or plural layers which are the same or different in composition. In the case of the plural layers, the silver-saving agent relating to the invention may be incorporated into all of the layers or a specified layer thereof. The image forming layer usually has a thickness of 10 to 30 $\mu$m.

In one preferred embodiment of the invention, the protective layer may contain the binder resin described in the foregoing backing layer and/or image forming layer and optionally additives. As an additive to be incorporated into the protective layer, a filler is preferably incorporated to prevent flaws of images caused after thermal development or to maintain transportability. The filler is incorporated preferably in an amount of 0.05 to 30% by weight, based on the image forming layer. A lubricant or antistatic agent may be incorporated into the protective layer to improve sliding property or antistatic property. These compounds may be selected from lubricants and antistatic agents used in the backing layer. In cases where the resin binder contained in the protective layer has a hydroxy group or an active hydrogen, cross-linking agents such as commonly known polyfunctional isocyanate compounds and metal alkoxide compounds containing plural metal alkoxide moieties such as alkoxysilane compounds and alkoxy silane compounds in the molecule may be incorporated to enhance layer strength within the range exerting no adverse effect on the object of the invention. Incorporation of such additives preferably is in an amount of 0.01 to 20% by weight, and more preferably 0.05 to 10% by weight, based on the protective layer constituents. The protective layer may be comprised of a single layer or plural layers which are the same or different in composition. The protective layer thickness is usually 1.0 to 5.0 $\mu$m.

In one preferred embodiment of the invention, to form the foregoing mage forming layer and protective layer, and a backing layer optionally provided, constituents described above are respectively dissolved or dispersed in a solvent tp prepare a coating solution. Solvents having a solubility parameter of 7.4 to 15.0, which is described in "YOZAI POCKET BOOK" (Solvent Pocket Book), edited by the Society of Organic Synthesis Chemistry, Japan, are preferably used in terms of solubility for resins and drying property in the manufacturing process. The solubility parameter is represented by $\delta[(cal/cm^3)^{1/2}]$ and solvents for use in coating solutions to form respective layers include, for example, ketones such as acetone (9.9), isophorone (9.1), ethyl amyl ketone (8.2), methyl ethyl ketone (9.3), methyl isobutyl ketone (8.4), cyclopentanone (10.4) and cyclohexanone (9.9); alcohols such as methyl alcohol (14.5), ethyl alcohol (12.7), n-propyl alcohol (11.9), isopropyl alcohol (11.5), n-butyl alcohol (11.4), isobutyl alcohol (10.5), t-butyl alcohol (10.6), 2-butyl alcohol (10.8), diacetone alcohol (9.2), and cyclohexanol (11.4); glycols such as ethylene glycol (14.6), diethylene glycol (12.1), triethylene glycol (10.7) and propylene glycol (12.6); ether alcohols such as ethylene glycol monomethyl ether (11.4) and diethylene glycol monoethyl ether (10.2ethers such as diethyl ether (7.4), tetrahydrofurane (9.1), 1,3-dioxolan (10.2) and 1,4-dioxane (10.0); esters such as ethylacetate (9.1), n-butylacetate (8.5), isobutylacetate (8.3); hydrocarbons such as n-heptane (7.4), cyclohexane (8.2)toluene (8.9) and xylene (8.8); and chlorides such as methyl chloride (9.7) and chloroform (9.3). Furthermore, nitrogen- or sulfur-containing solvents include, for example, dimethyl formamide (10.8), dimethyl sulfoxide (12.0), acrylonitrile (10.5) and pyridine (10.7). In the foregoing, numerals in the parentheses represent a solubility parameter. Unless the object of the invention is adversely affected, solvents usable in the invention are not limited to the foregoing solvents and usable alone or in combination.

A content of the foregoing solvents in the photothermographic materials relating to the invention can be adjusted in accordance with the temperature condition in the drying process after completion of the coating process. The residual solvent content in the photothermographic material is preferably 5 to 1000 mg/m$^2$, and more preferably 10 to 300 mg/m$^2$.

In cases when dispersing procedure is needed in the formation of coating solution, commonly known dispersing machines are optimally employed, including a two-roll mill, three-roll mil, ball mill, pebble mil, cobol mill, trone mill, sand mill, sand grinder, Sqegvari atreiter, high-speed impeller dispersant, high-speed stone mill, high-speed impact mill, disperser, high-speed mixer, homogenizer, ultrasonic dispersant, open kneader and continuous kneader.

Commonly known various coater stations are employed to coat coating solutions prepared as above on a support and examples thereof include an extrusion type extruding coater, reverse roll coater, gravure roll coater, air-docter coater, blade coater, air-knofe coater, squeeze coater, dipping coater, bar coater, transfer roll coater, kiss coater, cast coater, and spray coater. Of these coaters, an extrusion type extruding coater a roll coater such as an reverse roll coater are preferable to enhance uniformity in thickness of the layers described above. Coating the protective layer is not specifically limited unless the image forming layer is damaged, and in cases where a solvent used in a coating solution of the protective layer possibly dissolves the image forming layer, the extrusion type extruding coater gravure roll coater and bar coater can be used of the foregoing coater stations. Specifically when a contact coating system, such as a gravure roll coater and bar coater is used, the rotation direction of the gravure roll or bar may be normal or reverse with respect to the transport direction, and in the case of the normal rotation, there may be operated at a constant rate or at rates differing in circumferential speed.

As described above, coating and drying may be repeated for each layer. Alternatively, multi-layer coating may be conducted through a wet-on-wet system, in which the extrusion type extruding coater is used in combination with the foregoing reverse roll coater, gravure roll coater, air doctor coater, blade coater, air-knife coater, squeeze coater, dipping coater, bar coater, transfer roll coater, kiss coater, cast coater, spray coater or slide coater. In such multi-layer coating through a wet-on-wet system, the upper layer is coated on the lower layer in the wet state so that adhesion between the lower and upper layers is enhanced.

In the coating of an image forming layer coating solution on a support, it is preferred to subject the support surface to at least one surface treatment selected from a flame treatment, ozone treatment, glow discharge treatment, corona discharge treatment, plasma treatment vacuum ultraviolet radiation treatment, electron ray treatment and radiation ray treatment, followed by coating the image forming layer coating solution. Subjecting the support surface to such a surface treatment can strengthen adhesion between the support and image forming layer.

As one embodiment of the invention, in a photothermographic material on a support provided with an interlayer, an image forming layer and a protective layer in this order, the interlayer contains a alkoxysilane compound having at least two primary or secondary amino groups. Containing such a compound in the image forming layer leads to minimized fogging and variation in sensitivity irrespective of the keeping condition prior to thermal development, thereby resulting in images without causing a marked increase in contrast. The alkoxysilane compound can be selected from alkoxysilane compounds described earlier and used alone or in combination thereof.

As another embodiment of the invention, in a photothermographic material on a support provided with an interlayer, an image forming layer and a protective layer in this order, the interlayer contains at least one schiff base formed of dehydration condensation of an alkoxysilane compound having a primary amino group with a ketone compound. Similarly to the foregoing preferred embodiment, providing such an interlayer leads to minimized fogging and variation in sensitivity irrespective of the keeping condition prior to thermal development, thereby resulting in images without causing a marked increase in contrast. In this embodiment of the invention, a schiff base having at least one secondary amino group is preferred to achieve silver-saving and such a schiff base can be selected from the compounds described in the embodiment described earlier and used alone or in combination thereof.

In the foregoing embodiments, the alkoxysilane compound or schiff base is contained in the interlayer, preferably in an amount of 0.00001 to 0.10 mol per mol of silver in a unit area.

Besides the alkoxysilane compound or schiff base are incorporated a binder resin and various additives such as a filler and cross-linking agent in the interlayer. Examples of the binder resin used in the interlayer polyurethane type resin, polyester type resin, poly(vinyl acetal) type resin, cellulose type resin, phenoxy resin, epoxy resin, phenol novolac resin, polycarbonate resin, acryl type resin, or modified resins, in which a hydroxy group or carboxylic acid is introduced into a styrene type resin, polyolefin type resin, vinyl chloride type resin or a silicone resin. These resins may be used alone or in combination. Additives to be incorporated into the interlayer are selected from those incorporated into the image forming layer, protective layer and an optional backing layer, as described earlier and optimally used. The interlayer thickness is usually 0.005 to 2.0 $\mu$m and preferably 0.01 to 1.0 $\mu$m. The interlayer containing the alkoxysilane compound or schiff base not only achieves silver-saving, but also enhances adhesion between the support and image forming layer.

To form the interlayer, constituents described above are respectively dissolved or dispersed in a solvent tp prepare a coating solution. Solvents having a solubility parameter of 7.4 to 15.0, which is described in "YOZAI POCKET BOOK" (Solvent Pocket Book), edited by the Society of Organic Synthesis Chemistry, Japan, are preferably used in terms of solubility for resins and drying property in the manufacturing process. To coat the thus prepared coating solution for the interlayer, various coater stations described earlier can optionally be employed.

After coating the interlayer, as described earlier, coating and drying may be repeated for each of the image forming layer and protective layer. Alternatively, the interlayer and image forming layer or the interlayer, image forming layer and protectivelyer may simultaneously be coated through a wet-on-wet system, in which the extrusion type extruding coater is used in combination with various coates described earlier. In such multi-layer coating through a wet-on-wet system, the upper layer is coated on the lower layer in the wet state so that adhesion between the lower and upper layers is enhanced.

In the coating of the interlayer coating solution on a support, it is preferred to subject the support surface to at least one surface treatment selected from a flame treatment, ozone treatment, glow discharge treatment, corona discharge treatment, plasma treatment vacuum ultraviolet radiation treatment, electron ray treatment and radiation ray treatment, followed by coating the image forming layer coating solution. Subjecting the support surface to such a surface treatment can strengthen adhesion between the support and the interlayer.

In one preferred embodiment of the invention, incorporation of an isocyanate compound having at least two isocyanate group into the image forming layer is preferred to prevent variation of density in unexposed areas and incorporation an acid anhydride is also preferred to minimize fogging or variation in sensitivity caused by temperature fluctuation or rate variation during thermal development.

Essential constituents in the image forming layer including an organic silver salt, light-sensitive silver halide and reducing agent, the foregoing isocyanate compound having at least two isocyanate groups, the foregoing acid anhydride compound and various additives can be selected from those described in the constituents of the image forming layer, as set forth in the preferred embodiments described earlier. Further, amounts of such compounds and an image forming layer thickness are similar to those described in the foregoing preferred embodiments of the invention. Furthermore, the protective layer is similar to that in the foregoing preferred embodiments of the invention. Although incorporation of the isocyanate compound having at least two isocyanate groups and the acid anhydride has been described herein as a preferred embodiment, these compounds may be incorporated into the interlayer or both of the interlayer and image forming layer. In the preferred embodiment of the invention, the alkoxysilane compound having at least two primary or secondary amino groups, the schiff base formed of dehydration condensation reaction of an alkoxysilane compound having at least one primary amino group and a ketone compound is also incorporated into the interlayer or further into the image forming layer.

Next, suitable image recoding methods of the photothermographic material described above will be described. The image recording method according to the invention is classified into three embodiments according to an angle between lased light and the surface exposed to the light, laser wavelength and number of lasers. These may be conducted alone or in combination thereof, whereby clear images can be obtained without producing any interference fringe.

In the first preferred embodiment of the image recording method of the invention, exposure is conducted by the use of laser scanning exposure, in which scanning laser light is not exposed at an angle substantially vertical to the photothermographic material surface exposed to the laser. The expression "laser light is not exposed at an angle substantially vertical to the exposed surface" means that laser light is exposed preferably at an angle of 55 to 88°, more preferably 60 to 86°, and still more preferably 65 to 84°.

In the second preferred embodiment of the invention, exposure applicable in the invention is conducted preferably using a laser scanning exposure apparatus producing longitudinally multiple scanning laser light, whereby deterioration in image quality such as occurrence of interference fringe-like unevenness is reduced, as compared to scanning laser light with longitudinally single mode. Longitudinal multiplication can be achieved by a technique of employing backing light with composing waves or a technique of high frequency overlapping. The expression "longitudinally multiple" means that the exposure wavelength is not a single wavelength. The exposure wavelength distribution is usually not less than 5 nm and not more than 10 nm. The upper limit of the exposure wavelength distribution is not specifically limited but is usually about 60 nm.

In the third preferred embodiment of the invention, it is preferred to form images by scanning exposure using at least two laser beams. The image recording method using such plural laser beams is a technique used in image-writing means of a laser printer or a digital copying machine for writing images with plural lines in a single scanning to meet requirements for higher definition and higher speed, as described in JP-A 60-166916. This is a method in which laser light emitted from a light source unit is deflection-scanned with a polygon mirror and an image is formed on the photoreceptor through an fθ lens, and a laser scanning optical apparatus similar in principle to an laser imager.

In the image-writing means of laser printers and digital copying machines, image formation with laser light on the photoreceptor is conducted in such a manner that displacing one line from the image forming position of the first laser light, the second laser light forms an image from the desire of writing images with plural lines in a single scanning. Concretely, two laser light beams are close to each other at a spacing of an order of some ten μm in the sub-scanning direction on the image surface; and the pitch of the two beams in the sub-scanning direction is 63.5 μm at a printing density of 400 dpi and 42.3 μm at 600 dpi (in which the printing density is represented by "dpi", i.e., the number of dots per inch). As is distinct from such a method of displacing one resolution in the sub-scanning direction, one feature of the invention is that at least two laser beams are converged on the exposed surface at different incident angles to form images. In this case, when exposed with N laser beams, the following requirement is preferably met: when the exposure energy of a single laser beam (of a wavelength of λ nm) is represented by E, writing with N laser beam preferably meets the following requirement:

$$0.9\times E \leqq En\times N \leqq 1.1\times E$$

in which E is the exposure energy of a laser beam of a wavelength of λ nm on the exposed surface when the laser beam is singly exposed, and N laser beams each are assumed to have an identical wavelength and an identical exposure energy (En). Thereby, the exposure energy on the exposed surface can be obtained and reflection of each laser light onto the image forming layer is reduced, minimizing occurrence of an interference fringe.

In the foregoing, plural lasers at a wavelength of λ, but plural lasers differing in wavelength may be used. In this case, the wavelengths are preferably within the region of $(\lambda-30)<\lambda_1, \lambda_2, \ldots \lambda_n \leqq (\lambda+30)$.

In the first, second and third preferred embodiments of the image recording method of the invention, lasers for scanning exposure used in the invention include, for example, solid-state lasers such as ruby laser, YAG laser, and glass laser; gas lasers such as He—Ne laser, Ar laser, Kr ion laser, $CO_2$ laser, Co laser, He—Cd laser, $N_2$ laser and eximer laser; semiconductor lasers such as InGa laser, AlGaAs laser, GaAsP laser, InGaAs laser, InAsP laser, $CdSnP_2$ laser, and GSb laser; chemical lasers; and dye lasers. Of these, semiconductor lasers of wavelengths of 700 to 1200 nm are preferred in terms of maintenance and the size of the light source.

When the photothermographic material is scanned with laser light using an laser imager or laser image setter, the beam spot diameter on the surface of the photosensitive material is generally within the range of 5 to 75 μm with respect to minor axis and 5 to 100 μm with respect to major axis. The laser light scanning speed can be optimally set for respective photothermographic materials in accordance with sensitivity of the photothermographic material at the laser oscillating wavelength and a laser power.

EXAMPLES

The present invention will be further described in detail based on examples, but the invention is by no means limited to these. Amounts shown below are represented by percentage by weight (also denoted as wt %), unless specifically noted.

Example 1

Preparation of Photothermographic Material

Preparation of Backing Layer Coating Solution

A coating solution to form a backing layer was prepared in the following manner.

To 83 g of methyl ethyl ketone (MEK), 8.42 g of cellulose acetate butyrate (CAB381-20, available from Eastman Chemical Co.) and 0.45 g of polyester resin (Vitel PE2200B, available from Bostic Corp.) were added with stirring and dissolved therein. To the resulting solution was added 1.03 g of infrared dye 1, then, 4.5 g fluorinated surfactant [Surflon S-381 (active ingredients of 70%) available from ASAHI Glass Co. Ltd.] and 0.23 g fluorinated surfactant (Megafac F120K, available from DAINIPPON INK Co. Ltd.) which were dissolved in 4.32 g methanol, were added thereto and stirred until being dissolved. Then, 7.5 g of silica (Siloid 64×6000, available from W. R. Grace Corp.), which was dispersed in methyl ethyl ketone in a concentration of 1 wt % using a dissolver type homogenizer, was added and then 1.78 g of isocyanate compound (Coronate C-3041, available from Nippon Polyurethane Ind. Co., Ltd.) was further added thereto with stirring to obtain a coating solution for the backing layer.

Infrared dye 1

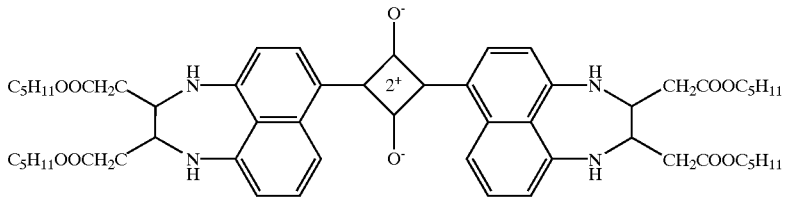

Backing Layer Coating

One side of a blue-tinted, 175 μm thick, biaxially stretched polyethylene terephthalate film, which was tinted so as to have a blue density of 0.1 (which was determined to decimal three significant figures using densitometer PDA-65, available from Konica Corp.) using a blue dye (Ceres Blue RR-J, available from Bayer Co.), was subjected to a plasma treatment in an atmosphere of argon, nitrogen and hydrogen in a volume ratio of 90%, 5% and 5%, respectively, using a batch type atmospheric plasma treatment apparatus (AP-I-H-340, available from E.C. Chemicals Co.) at a high frequency output of 4.5 kW and a frequency of 5 kHz for 5 sec. The other side of the film was also subjected to a corona discharge treatment (at 40 $W/m^2\cdot min$). The thus prepared coating solutions was coated on the side that was subjected to the corona discharge treatment, using an extrusion coater and dries so as to form a dry layer of 3.5 μm.

Preparation of Image Forming Layer Coating Solution

Preparation of Light-sensitive Silver Halide Emulsion 1

In 900 ml of deionized water were dissolved 7.5 g of gelatin having an average molecular weight of 100,000 and 10 mg of potassium bromide. After adjusting the temperature and the pH to 35° C. and 3.0, respectively, 370 ml of an aqueous solution containing 74 g silver nitrate and an equimolar aqueous halide solution containing potassium bromide, potassium iodide (in a molar ratio of 98 to 2) and $1\times10^{-4}$ mol/mol Ag of iridium chloride were added over a period of 10 minutes by the controlled double-jet method, while the pAg was maintained at 7.7. Thereafter, 4-hydroxy-6-methyl-1,3,3a,7-tetraazaindene was added and the pH was adjusted to 5 using NaOH. There was obtained cubic silver iodobromide grains having an average grain size of 0.06 μm, a variation coefficient of the projection area equivalent diameter of 12 percent, and the proportion of the {100} face of 87 percent. The resulting emulsion was flocculated to remove soluble salts, employing a flocculating agent and after desalting, 0.1 g of phenoxyethanol was added and the pH and pAg were adjusted to 5.9 and 7.5, respectively to obtain light-sensitive silver halide emulsion 1.

Preparation of Powdery Organic Silver Salt A

In 4720 ml water were dissolved 111.4 g of behenic acid, 83.8 g of arachidic acid and 54.9 g of stearic acid at 80° C. Then, after adding 540.2 ml of 1.5M aqueous sodium hydroxide solution with stirring and further adding 6.9 ml of concentrated nitric acid, the solution was cooled to a temperature of 55° C. to obtain an aqueous organic acid sodium salt solution. To the solution were added the silver halide emulsion 1 obtained above (containing equivalent to 0.038 mol silver) and stirring further continued for 5 min., while maintained at a temperature of 55° C. Subsequently, 760.6 ml of 1M aqueous silver nitrate solution was added in 2 min. and stirring continued further for 20 min., then, the reaction mixture was filtered to remove aqueous soluble salts. Thereafter, washing with deionized water and filtration were repeated until the filtrate reached a conductivity of 2 μS/cm, and after subjecting to centrifugal dehydration, the reaction product was dried with heated air at 37° C. until no reduction in weight was detected to obtain powdery organic silver salt A.

Preparation of Light-sensitive Emulsified Dispersion

In 1457 g methyl ethyl ketone was dissolved 14.57 g of poly(vinyl butyral) powder (S-lec BL-5Z, available from Sekisui Chemical Co., Ltd.) and further thereto was gradually added 500 g of the powdery organic silver salt A with stirring by a dissolver type homogenizer. Thereafter, the mixture was dispersed using a media type dispersion machine (available from Gettzmann Corp.), which was packed 1 mm Zr beads (available from Toray Co. Ltd.) by 80%, at a circumferential speed of 13 m and for 0.5 min. of a retention time with a mill to obtain light-sensitive emulsified dispersion.

Preparation of Image Forming Layer Coating Solution

Light-sensitive emulsified dispersion of 50 g and 10.0 g of methyl ethyl ketone were mixed and maintained at 18° C., and 0.320 g of antifoggant 1 methanol solution (11.2%) was added thereto and stirred for 1 hr. Further thereto, 0.212 g of calcium bromide methanol solution (11.2%) was added and stirred for 20 min. Further thereto was added a solution, in which 1.00 g of dibenzo-18-crown-6 and 0.31 g of potassium acetate were dissolved in 10.0 g of methanol. Subsequently, 4.395 g of dye solution 1 was added thereto and stirred for 60 min. and then cooled to a temperature of 13° C. and further stirred for 50 min.

| Dye solution 1 | |
|---|---|
| Infrared dye 1 | 0.0086 g |
| Benzoic acid derivative 1 | 2.476 g |
| Methyl ethyl ketone | 25.00 g |

Further thereto, 0.766 g of a methanol solution (0.50%) of a thiuronium compound (Exemplified compound, T-7) was added and after stirred for 5 min., 13.29 g of poly(vinyl butyral) (S-lec BL-5Z, available from Sekisui Chemical Co., Ltd.) and 0.304 g of tetrachlorophthalic acid were added thereto and sufficiently dissolved with stirring.

To the thus obtained solution were successively added methyl ethyl ketone solutions Nos. 1, 2, 3 and 4, as shown below, in an amount of 2.261 g, 13.543 g, 3.491 g and 4.597 g, respectively, with stirring, and then, a methanol solution of an alkoxysilane compound (40% solid) as shown in Table 1 was added in a molar ratio to silver per unit area, with stirring to obtain coating solutions Nos. 2 through 19 for a image forming layer. In Table 1, an acid anhydride, in which cis-1,2-cyclohexane-dicarboxylic acid anhydride was dissolved in methyl ethyl ketone (20% solid) was added to the respective coating solutions in an amount of 0.0313 mol/mol Ag, prior to addition of a silane coupling agent. Similarly were prepared coating solution No. 1, in which the alkoxy silne compound was not added and coating solutions Nos. 20 and 21, in which commonly known hardening agent (C-1), i.e., ethyl 2-(ethoxymethylene)-2-cyanoacetate was added in place of the alkoxysilane compound.

| | |
|---|---|
| Solution 1 | |
| Isocyanate compound (Sumijule N-3300, available from Sumitomo Bayer Urethane Co., Ltd.) | 5.630 g |
| Potassium p-toluenethiosufonate | 0.415 g |
| Methyl ethyl ketone | 20.00 g |
| Solution 2 | |
| 1,1-Bis (2-hydroxy-3,5-dimethylpheny)-3,5,5-trimethylhexane | 6.070 g |
| 4-Methylphthalic acid | 0.401 g |
| Infrared dye 1 | 0.0262 g |
| Methyl ethyl ketone | 20.00 g |
| Solution 3 | |
| Trihalomethyl-containing compound (P-15) | 1.543 g |
| 2-Phenyl-4,6-bis (trichloromethyl)-s-triazine | 1.407 g |
| Methyl ethyl ketone | 10.01 g |
| Solution 4 | |
| Phthalazine | 1.420 g |
| Methyl ethyl ketone | 20.00 g |

Antifoggant 1

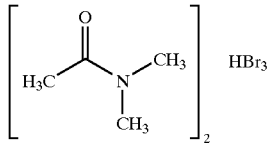

Infrared sensitizing dye 1

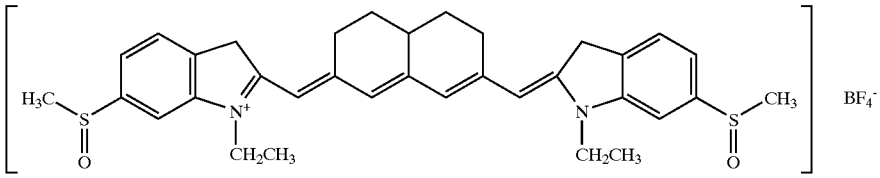

Benzoic acid derivative 1

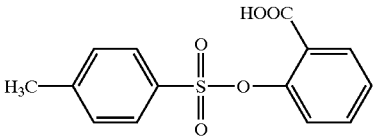

Preparation of Protective Layer Coating Solution

In 86.5 g of methyl ethyl ketone were dissolved 10.05 g of cellulose acetate butyrate (CAB171-15, available from Eastman Chemical Co.), 0.013 g of benztriazole and 0.10 g fluorinated surfactant (Surflon KH40 available from ASAHI Glass Co. Ltd.). Separately, to 55.0 g of cellulose acetate butyrate solution (CAB171-15, available from Eastman Chemical Co.), which was dissolved in methyl ethyl ketone in 15% solid was added 5 g of silica Silica particles (SYLYSIA 320, available from FUJI SYLYSIA Co.) and the mixture was dispersed using a media dispersing machine filled with zircoania beads to obtain a silica dispersion. The thus obtained silica dispersion of 3.0 g was added to the foregoing resin solution dissolved with benztriazole and dispersed using a ultrasonic homogenizer to obtain a coating solution for a protective layer.

Coating of Image Forming Layer Side

The foregoing coating solutions of image forming layers Nos. 1 through 21 were each coated so that a wet layer thickness was varied so as to have a silver coverage shown in Table 1 and the protective layer coating solution was simultaneously coated by an extrusion coater and dried by hot air at 70° C. to obtain photothermographic material samples. The protective layer thickness was adjusted to 2.35+0.15 $\mu$m and the coating solution for the image forming layer was used within 30 after adding the silane coupling agent.

TABLE 1

| | | Image Forming Layer | | | | | | |
|---|---|---|---|---|---|---|---|---|
| | Silver Cover- | | | | Acid Anhydride | Development | | |
| Sample No. | age (g/m$^2$) | Coating Solution | Alkoxysilane (mol/mol Ag) | | (mol/mol Ag) | Temp. (° C.) | Time (sec) | Remark |
| 1-1 | 1.95 | 1 | — | | — | 126 | 13.6 | Comp. |
| 1-2 | 1.30 | 1 | — | | — | 126 | 13.6 | Comp. |
| 1-3 | 1.30 | 2 | A-1 | (0.0050) | — | 126 | 13.6 | Inv. |
| 1-4 | 1.30 | 3 | A-1 | (0.0125) | — | 126 | 13.6 | Inv. |
| 1-5 | 1.30 | 4 | A-1 | (0.0125) | — | 124 | 13.6 | Inv. |
| 1-6 | 1.30 | 4 | A-1 | (0.0125) | — | 126 | 13.6 | Inv. |
| 1-7 | 1.30 | 4 | A-1 | (0.0125) | — | 128 | 13.6 | Inv. |
| 1-8 | 1.30 | 5 | A-1 | (0.0125) | 0.0313 | 124 | 13.6 | Inv. |
| 1-9 | 1.30 | 5 | A-1 | (0.0125) | 0.0313 | 126 | 13.6 | Inv. |
| 1-10 | 1.30 | 5 | A-1 | (0.0125) | 0.0313 | 128 | 13.6 | Inv. |
| 1-11 | 1.30 | 6 | A-2 | (0.0125) | — | 126 | 13.6 | Inv. |
| 1-12 | 1.30 | 7 | A-2 | (0.0250) | 0.0313 | 126 | 13.6 | Inv. |
| 1-13 | 1.30 | 8 | A-5 | (0.0125) | — | 126 | 13.6 | Inv. |
| 1-14 | 1.30 | 9 | A-7 | (0.0125) | — | 126 | 12.1 | Inv. |
| 1-15 | 1.30 | 9 | A-7 | (0.0125) | — | 126 | 13.6 | Inv. |
| 1-16 | 1.30 | 9 | A-7 | (0.0125) | — | 126 | 15.1 | Inv. |
| 1-17 | 1.30 | 10 | A-7 | (0.0125) | 0.0313 | 126 | 12.1 | Inv. |
| 1-18 | 1.30 | 10 | A-7 | (0.0125) | 0.0313 | 126 | 13.6 | Inv. |
| 1-19 | 1.30 | 10 | A-7 | (0.0125) | 0.0313 | 126 | 15.1 | Inv. |
| 1-20 | 1.30 | 11 | A-8 | (0.0125) | — | 126 | 13.6 | Inv. |
| 1-21 | 1.30 | 12 | A-14 | (0.0125) | — | 126 | 13.6 | Inv. |
| 1-22 | 1.30 | 13 | A-15 | (0.0050) | — | 126 | 13.6 | Inv. |
| 1-23 | 1.30 | 14 | A-15 | (0.0075) | 0.0313 | 126 | 13.6 | Inv. |
| 1-24 | 1.30 | 15 | A-17 | (0.0125) | — | 126 | 13.6 | Inv. |
| 1-25 | 1.30 | 16 | A-18 | (0.0125) | — | 126 | 13.6 | Inv. |
| 1-26 | 1.30 | 17 | A-21 | (0.0075) | 0.0313 | 126 | 13.6 | Inv. |
| 1-27 | 1.30 | 18 | A-22 | (0.0075) | 0.0313 | 126 | 13.6 | Inv. |
| 1-28 | 1.30 | 19 | A-26 | (0.0125) | — | 126 | 13.6 | Inv. |
| 1-29 | 1.30 | 20 | C-1 | (0.0250) | — | 126 | 13.6 | Comp. |
| 1-30 | 1.30 | 21 | C-1 | (0.2500) | — | 124 | 13.6 | Comp. |
| 1-31 | 1.20 | 21 | C-1 | (0.2500) | — | 126 | 13.6 | Comp. |

Image Recording and Image Evaluation

Image Recording

Photothermographic material samples, which were aged under the light-shielding at room temperature (23° C., 55% RH) for 72 hrs., and samples, which were aged in a incubator at 50° C. and 55% RH for 72 hrs., were respectively subjected to laser scanning exposure with varying the exposure amount from the emulsion side using an exposure apparatus having a light source of 800 to 820 nm semiconductor laser of a longitudinal multi-mode, which was made by means of high frequency overlapping. Subsequently, using an automatic processor provided with a heated drum, the thus exposed samples were subjected to thermal development under the developing condition shown in Table 1, while bringing the protective layer surface of the photothermographic material into contact with the drum surface. The thus thermally developed photothermographic material samples 1-1 through 1-31 were obtained. Laser scanning exposure was conducted at an angle of 70°, between the exposed surface and exposing laser light and at laser spot diameters of 100 μm in the main scanning direction and 75 μm in the sub-scanning direction. There was employed an automatic processor, which was provided with a heating drum having a surface rubber hardness of 70, as defined in JIS K6253 Type A.

Image Evaluation

The thus exposed and thermally developed samples were evaluated with respect to sensitivity, gamma, maximum density and fog density, based on the criteria described below.

Sensitivity (S)

Samples were each subjected to densitometry with respect to visual transmission density of formed silver images, using a densitometer (PDA-65, available from Konica Corp., decimal significant figures of three). Sensitivity was defined as the reciprocal of exposure giving a density of 1.0 above unexposed area and represented by a relative value, based on the sensitivity of sample 1, which was not added with the alkoxysilane compound and aged at room temperature being 100. The exposure giving a density of 1.0 above an unexposed area was measured at least three times within the density region of +0.7 to +1.2 above an unexposed area and determined by linear regression.

Gamma (γ)

Gamma was defined as a slope of a straight line connecting image densities of 0.25 and 2.0 (tan θ) and evaluated as a measure of gradation. Herein, the image density means a density of an image density minus a fog density.

Maximum Density (D max)

Visual transmission densities were measured at ten points in the maximum exposed area using a densitometer (PDA-65, available from Konica Corp., decimal significant figures of three) and an averaged value thereof was defined as the maximum density (D max).

Fog Density

Visual transmission densities were measured at ten points in unexposed areas using a densitometer (PDA-65, available from Konica Corp., decimal significant figures of three) and an averaged value thereof was defined as a fog density (denoted as D min).

The thus obtained results are shown in Table 2.

TABLE 2

| Sample | Room Temp. Aging (23° C., 55%) | | | | High Temp. Aging (50° C., 55% | | | | |
|---|---|---|---|---|---|---|---|---|---|
| No. | S | γ | Dmax | Dmin | S | γ | Dmax | Dmin | Remark |
| 1-1 | 100 | 3.55 | 3.65 | 0.190 | 87 | 3.45 | 3.42 | 0.198 | Comp. |
| 1-2 | 94 | 2.84 | 2.43 | 0.185 | 78 | 2.22 | 2.21 | 0.191 | Comp. |
| 1-3 | 96 | 3.21 | 2.79 | 0.186 | 95 | 3.18 | 2.85 | 0.194 | Inv. |
| 1-4 | 101 | 3.79 | 3.16 | 0.186 | 100 | 3.65 | 3.26 | 0.196 | Inv. |
| 1-5 | 100 | 4.12 | 3.52 | 0.188 | 98 | 4.06 | 3.58 | 0.198 | Inv. |
| 1-6 | 105 | 4.53 | 3.59 | 0.188 | 103 | 4.32 | 3.62 | 0.198 | Inv. |
| 1-7 | 110 | 4.68 | 3.65 | 0.188 | 106 | 4.52 | 3.64 | 0.198 | Inv. |
| 1-8 | 100 | 4.08 | 3.45 | 0.184 | 100 | 4.03 | 3.54 | 0.194 | Inv. |
| 1-9 | 101 | 4.13 | 3.48 | 0.184 | 100 | 4.08 | 3.55 | 0.193 | Inv. |
| 1-10 | 102 | 4.16 | 3.49 | 0.184 | 101 | 4.11 | 3.54 | 0.194 | Inv. |
| 1-11 | 100 | 3.68 | 3.09 | 0.186 | 98 | 3.51 | 3.15 | 0.194 | Inv. |
| 1-12 | 100 | 4.03 | 3.41 | 0.183 | 99 | 3.95 | 3.55 | 0.192 | Inv. |
| 1-13 | 98 | 3.65 | 3.09 | 0.185 | 97 | 3.56 | 3.21 | 0.193 | Inv. |
| 1-14 | 97 | 3.86 | 3.35 | 0.187 | 95 | 3.78 | 3.45 | 0.194 | Inv. |
| 1-15 | 101 | 4.01 | 3.45 | 0.188 | 99 | 3.91 | 3.55 | 0.195 | Inv. |
| 1-16 | 105 | 4.12 | 3.52 | 0.188 | 101 | 4.06 | 3.64 | 0.195 | Inv. |
| 1-17 | 99 | 3.81 | 3.18 | 0.185 | 99 | 3.76 | 3.35 | 0.192 | Inv. |
| 1-18 | 100 | 3.85 | 3.21 | 0.185 | 100 | 3.81 | 3.38 | 0.192 | Inv. |
| 1-19 | 101 | 3.89 | 3.24 | 0.185 | 101 | 3.84 | 3.41 | 0.192 | Inv. |
| 1-20 | 99 | 4.36 | 3.12 | 0.186 | 97 | 4.13 | 3.24 | 0.194 | Inv. |
| 1-21 | 102 | 4.21 | 3.23 | 0.187 | 101 | 4.11 | 3.39 | 0.195 | Inv. |
| 1-22 | 98 | 3.42 | 3.01 | 0.185 | 97 | 3.21 | 3.24 | 0.198 | Inv. |
| 1-23 | 100 | 3.56 | 3.21 | 0.182 | 99 | 3.46 | 3.45 | 0.192 | Inv. |
| 1-24 | 99 | 3.22 | 3.21 | 0.186 | 97 | 3.12 | 3.46 | 0.195 | Inv. |
| 1-25 | 101 | 3.15 | 3.15 | 0.188 | 98 | 3.03 | 3.25 | 0.195 | Inv. |
| 1-26 | 100 | 4.03 | 3.32 | 0.188 | 98 | 3.87 | 3.42 | 0.194 | Inv. |
| 1-27 | 100 | 4.12 | 3.16 | 0.186 | 98 | 3.85 | 3.26 | 0.194 | Inv. |
| 1-28 | 102 | 4.21 | 3.52 | 0.186 | 100 | 4.02 | 3.68 | 0.193 | Inv. |
| 1-29 | 93 | 2.85 | 2.41 | 0.185 | 78 | 1.26 | 2.24 | 0.193 | Inv. |
| 1-30 | 125 | 11.28 | 3.29 | 0.194 | 109 | 9.65 | 3.52 | 0.214 | Comp. |
| 1-31 | 134 | 13.52 | 3.35 | 0.196 | 115 | 10.34 | 3.68 | 0.215 | Comp. |

As apparent from Table 2, it was proved that samples containing an alkoxysilane compound exhibited an optimum gradation without producing excessively high contrast as well as higher D max and lower D min and minimized variation in gamma, D max and D min, even after aged at a high temperature, leading to superior storage stability, compared to comparative samples. Specifically, it was noted that the combined use of an acid anhydride with the alkoxysilane compound resulted in further enhanced effects thereof.

Example 2

Preparation of Photothermographic Material

Coating solutions of an image forming layer Nos. 22 through 31 were prepared in accordance with the following procedure. Similarly to Example 1, the image forming layer coating solution was coated simultaneously with the protective layer coating solution of Example 1 to prepare a photothermographic material sample, in which silver coverage per unit area was adjusted as shown in Table 3 and a protective layer thickness was adjusted to 2.35±0.15 μm.

Preparation of Image Forming Layer Coating Solutions 22 to 31

A light-sensitive emulsified dispersion of 50 g, which was prepared in a manner similar to Example 1 was mixed with 10.0 g of methyl ethyl ketone and stirred, while being maintained at 21° C. The mixture was further added with 0.320 g of a methanol solution of antifoggant 1 (11.2%) and stirred. Further thereto, 0.424 f g of a methanol solution of calcium bromide (11.2%) was added and stirred for 20 min. Subsequently, 0.343 g of a solution, in which 1.00 g of dibenzo-18-crown-6 and 0.31 g of potassium acetate were dissolved in 10.0 g of methanol, was added thereto and stirred for 10 min.

Next, 2.622 g of the following dye solution 2 was added and stirred for 1 hr. and then, the mixture was cooled to a temperature of 13° C. and stirred for 30 min:

| Dye solution 2 | |
|---|---|
| Infrared sensitizing dye 2 | 0.0192 g |
| Benzoic acid derivative 1 | 2.779 g |
| 2-Chloro-benzoic acid | 1.488 g |
| 5-Methyl-2-mercaptobenzimidazole | 0.365 g |
| Methyl ethyl ketone | 25.205 g |

The solution added with the foregoing dye solution 2 was maintained at 13° C. and further thereto, 13.29 g of poly (vinyl butyral) powder (S-lec BL-5Z, available from Sekisui Chemical Co., Ltd.) and 0.304 g of tetrachlorophthalic acid were successively added and dissolved with sufficiently stirring.

To the thus obtained solution were successively added methyl ethyl ketone solutions Nos. 5, 6, 7 and 8, as shown below, in an amount of 2.261 g, 13.543 g, 5.732 g and 4.597 g, respectively, with stirring, and then, a methanol solution of a schiff base (40% solid) as shown in Table 3 was added in a molar ratio to silver per unit area, with stirring to obtain coating solutions Nos. 23 through 30 for a image forming layer. In Table 3, an acid anhydride, in which trans-1,2-cyclohexane-dicarboxylic acid anhydride was dissolved in methyl ethyl ketone (20% solid) was added to the respective coating solutions in an amount of 0.0313 mol/mol Ag, prior to addition of the schiff base. Similarly were prepared coating solution No. 22, in which the schiff base was not added and coating solution No. 31, in which commonly known hardening agent (C-1), i.e., ethyl 2-(ethoxymethylene)-2-cyanoacetate was added in place of the schiff base.

| | |
|---|---|
| Solution 5 | |
| Isocyanate compound (Sumijule N-3300, available from Sumitomo Bayer Urethane Co., Ltd.) | 5.630 g |
| Methyl ethyl ketone | 20.00 g |
| Solution 6 | |
| 1,1-Bis (2-hydroxy-3,5-dimethylpheny)-3,5,5-trimethylhexane | 6.070 g |
| 4-Methylphthalic acid | 0.401 g |
| Infrared dye 1 | 0.0262 g |
| Methyl ethyl ketone | 20.00 g |
| Solution 7 | |
| Trihalomethyl-containing compound (P-15) | 1.407 g |
| Methyl ethyl ketone | 20.00 g |
| Solution 8 | |
| Phthalazine | 1.420 g |
| Methyl ethyl ketone | 20.00 g |

Coating of Image Forming Layer Side

Similarly to Example 1, coating solutions No. 22 through 31 for an image forming layer were each coated on the support having provided with a backing layer, simultaneously with the protective layer coating solution used in Example 1 to prepare photothermographic material samples. Silver coverage per unit area of the respective image forming layers was adjusted to an amount shown in Table 3, and a protective layer thickness was adjusted to 2.35±0.15 μm. Coating was conducted with varying the period of from preparation to coating of the image forming layer coating solution (also called a standing time), as shown in Table 3.

Image Recording and Image Evaluation

Image Recording

Image recording was carried out similarly to Example 1 and thermal development was conducted under the condition shown in Table 3 to obtain exposed and thermally developed photothermographic material samples 2-1 through 2-19.

Image Evaluation

Obtained images were evaluated, based on the criteria similar to Example 1 and results thereof are shown in Table 3. Sensitivity was represented by a relative value, based on the sensitivity of sample 1-1 of Example 1 being 100.

TABLE 3

| Sample No. | Silver Coverage ($g/m^2$) | Image Forming Layer: Coating Solution | Image Forming Layer: Schiff Base (mol/mol Ag) | Image Forming Layer: Acid Anhydride (mol/mol Ag) | Image Forming Layer: Standing Time (min) | Development: Temp. (° C.) | Development: Time (sec) |
|---|---|---|---|---|---|---|---|
| 2-1 | 1.95 | 22 | — | — | — | 126 | 13.6 |
| 2-2 | 1.30 | 22 | — | — | — | 126 | 13.6 |
| 2-3 | 1.30 | 23 | S-3 (0.0125) | — | 5 | 126 | 13.6 |
| 2-4 | 1.30 | 23 | S-3 (0.0125) | — | 20 | 126 | 13.6 |
| 2-5 | 1.30 | 23 | S-3 (0.0125) | — | 60 | 126 | 13.6 |
| 2-6 | 1.30 | 24 | S-3 (0.0250) | 0.0313 | 5 | 126 | 13.6 |
| 2-7 | 1.30 | 25 | S-3 (0.0375) | 0.0313 | 5 | 126 | 13.6 |
| 2-8 | 1.30 | 26 | S-6 (0.0125) | — | 5 | 126 | 13.6 |
| 2-9 | 1.30 | 27 | S-6 (0.0250) | 0.0313 | 5 | 124 | 13.6 |
| 2-10 | 1.30 | 27 | S-6 (0.0250) | 0.0313 | 5 | 126 | 13.6 |
| 2-11 | 1.30 | 27 | S-6 (0.0250) | 0.0313 | 5 | 128 | 13.6 |
| 2-12 | 1.30 | 27 | S-6 (0.0250) | 0.0313 | 5 | 126 | 12.1 |
| 2-13 | 1.30 | 27 | S-6 (0.0250) | 0.0313 | 5 | 126 | 15.1 |
| 2-14 | 1.30 | 28 | S-9 (0.0250) | 0.0313 | 5 | 126 | 13.6 |
| 2-15 | 1.30 | 29 | S-11 (0.0125) | — | 5 | 126 | 13.6 |
| 2-16 | 1.30 | 30 | S-15 (0.0125) | — | 5 | 126 | 13.6 |
| 2-17 | 1.20 | 31 | C-1 (0.2500) | — | 5 | 126 | 13.6 |
| 2-18 | 1.20 | 31 | C-1 (0.2500) | — | 20 | 126 | 13.6 |
| 2-19 | 1.20 | 31 | C-1 (0.2500) | — | 60 | 126 | 13.6 |

| Sample | Room Temp. Aging (23° C., 55%) | | | | High Temp. Aging (50° C., 55% | | | | |
|---|---|---|---|---|---|---|---|---|---|
| No. | S | γ | Dmax | Dmin | S | γ | Dmax | Dmin | Remark |
| 2-1 | 98 | 3.34 | 3.45 | 0.193 | 86 | 3.12 | 3.21 | 0.190 | Comp. |
| 2-2 | 93 | 2.65 | 2.21 | 0.188 | 77 | 2.06 | 2.01 | 0.185 | Comp. |
| 2-3 | 96 | 3.59 | 2.89 | 0.188 | 93 | 3.36 | 2.92 | 0.189 | Inv. |
| 2-4 | 96 | 3.58 | 2.90 | 0.187 | 94 | 3.35 | 2.93 | 0.189 | Inv. |
| 2-5 | 96 | 3.57 | 2.91 | 0.188 | 93 | 3.37 | 2.93 | 0.189 | Inv. |
| 2-6 | 97 | 3.64 | 3.06 | 0.185 | 95 | 3.42 | 3.15 | 0.186 | Inv. |
| 2-7 | 98 | 3.94 | 3.21 | 0.188 | 96 | 3.82 | 3.29 | 0.189 | Inv. |
| 2-8 | 99 | 3.72 | 3.11 | 0.189 | 98 | 3.61 | 3.21 | 0.191 | Inv. |
| 2-9 | 99 | 3.98 | 3.35 | 0.188 | 99 | 3.91 | 3.48 | 0.188 | Inv. |
| 2-10 | 101 | 4.03 | 3.41 | 0.188 | 100 | 3.99 | 3.51 | 0.189 | Inv. |
| 2-11 | 103 | 4.10 | 3.48 | 0.188 | 101 | 4.02 | 3.56 | 0.189 | Inv. |
| 2-12 | 100 | 3.98 | 3.38 | 0.188 | 99 | 3.93 | 3.47 | 0.188 | Inv. |
| 2-13 | 104 | 4.11 | 3.51 | 0.188 | 102 | 4.03 | 3.53 | 0.188 | Inv. |
| 2-14 | 102 | 4.25 | 3.68 | 0.189 | 100 | 4.19 | 3.78 | 0.189 | Inv. |
| 2-15 | 100 | 4.11 | 3.20 | 0.189 | 99 | 4.01 | 3.32 | 0.190 | Inv. |
| 2-16 | 100 | 4.03 | 3.46 | 0.187 | 98 | 3.95 | 3.51 | 0.191 | Inv. |
| 2-17 | 130 | 12.56 | 3.29 | 0.188 | 113 | 9.56 | 3.52 | 0.213 | Comp. |
| 2-18 | 132 | 12.75 | 3.29 | 0.201 | 114 | 9.78 | 3.55 | 0.218 | Comp. |
| 2-19 | 138 | 13.68 | 3.30 | 0.204 | 116 | 10.23 | 3.75 | 0.231 | Comp. |

As apparent from Table 3, it was proved that samples having an image forming layer containing a shiff base exhibited a proper gradation without producing excessively high contrast as well as higher D max and lower D min, and minimized variation in gamma, D max and D min, even when stood over a period of time after preparing a coating solution, leading to superior storage stability, compared to comparative samples. Specifically, it was noted that the use of an acid anhydride in combination with the schiff base resulted in further enhanced effects thereof.

Example 3

Preparation of Photothermographic Material

Photothermographic materials were prepared according to the following procedure.

Preparation of Interlayer Coating Solution

Polyurethane resin (Vylon UR-2300, available from TOYOBO Co., Ltd.) was dissolved in a solvent comprised of methyl ethyl ketone, toluene and cyclohexane (by weight ratio of 55:40:5) in a concentration of 10% solid to obtain a binder resin solution. Separately, cross-linked acryl resin particles (MX-150, available from SOKEN CHEMICAL & ENGINEERING Co., Ltd.) were dispersed in 45.0 g of methyl ethyl ketone with stirring by a dissolver to obtain a filler dispersion. To 98 g of the thus prepared binder resin solution, 2.0 g of the filler dispersion was added with stirring and then, an alkoxysilane compound shown in Table 4, which was dissolved in methanol so as to have a concentration of 40% solid, was added thereto in a molar ratio to silver per unit area, as shown in Table 4 to prepare interlayer coating solutions No. 2 through 9. Similarly were prepared coating solution No. 1, in which the the alkoxysilane compound was not added and coating solution No. 10, in which commonly known hardening agent (C-1), i.e., ethyl 2-ethoxymethylene)2-cyanoacetate was added in place of the alkoxysilane compound.

Coating of Interlayer Coating Solution

The opposite side of a 175 μm thick biaxially stretched polyethylene terephthalate film to the backing layer, which was formed similarly to Example 1, was subjected to a corona discharge treatment (80 W/m$^2$·min). On the side subjected to the corona discharge treatment, the interlayer coating solutions were each coated using an extrusion coater and dried by hot air at 70° C. to form an interlayer with a coverage of 0.30 g/m$^2$. The interlayer coating solutions were used within 30 min. after adding the silane coupling agent.

Preparation of Image Forming Layer Coating Solution

Coating solution 32 of an image forming layer was prepared similarly to coating solution 22 of an image forming layer, used in Example 2, provided that trans-1,2-cyclohexane-dicarboxylic acid anhydride which was dissolved in methyl ethyl ketone (20% solid) was added, as an acid anhydride, to the image forming layer coating solution in an amount of 0.0313 mol per mol of silver.

Coating of Image Forming Layer and Protective Layer

On the support having been coated with the interlayer, each of the image forming layer coating solutions and a protective layer coating solution were simultaneously coated in the combination shown in Table 4, using an extrusion coater and dried by hot air at 70° C. to prepare photothermographic material samples. Silver coverage per unit are was adjusted as shown in Table 4 and a protective layer thickness was also adjusted to 2.35±0.15 μm.

Image Recording and Image Evaluation

Image Recording

Photothermographic material samples were aged under the light-shielding at room temperature (23° C., 55% RH) for 72 hrs. and were respectively subjected to laser scanning exposure with varying the exposure amount from the emulsion side using an exposure apparatus having a light source of 800 to 820 nm semiconductor laser of a longitudinal multi-mode, which was made by means of high frequency overlapping. Subsequently, using an automatic processor provided with a heated drum, the thus exposed samples were subjected to thermal development under the developing condition shown in Table 1, while bringing the protective layer surface of the photothermographic material into contact with the drum surface. The thus thermally developed photothermographic material samples 3-1 through 3-13 were obtained. Laser scanning exposure was conducted at an angle of 70°, between the exposed surface and exposing laser light and at laser spot diameters of 100 μm in the main scanning direction and 75 μm in the sub-scanning direction. There was employed an automatic processor, which was provided with a heating drum having a surface rubber hardness of 70, as defined in JIS K6253 Type A.

Image Evaluation

Similarly to Example 1, samples were evaluated with respect to sensitivity (S), gamma (γ), maximum density (D max) and fog density (D min), provided that sensitivity was represented by a relative value, based on the sensitivity of photothermographic material sample 1-1 of Example 1 being 100. Furthermore, samples were evaluated with respect to adhesion of a layer to the support (frilling) in accordance with the following procedure.

Frilling Test

Photothermographic material samples, which were aged at room temperature (23° C. and 55% RH) for 72 hr. was fixed, with a protective layer upward, at a distance of 5 mm from the portion to be cut. Cutting was conducted using a cutter for photographic use (available from Konica Corp.), at two different speeds (i.e., at slow and fast speeds). The cut surface of each sample was observed over a length of 150 mm by an electron microscope and the width (mm) of the portion causing frilling from the cut edge (i.e., the distance from the cutting edge to the frilling edge) was measured and the maximum value thereof was evaluated as a measure of frilling. Thus, the larger value indicates causing more frilling.

Results are shown in Table 4.

TABLE 4

| | | Interlayer | | Image Forming Layer | | | | | | | | Frilling (mm) | | |
|---|---|---|---|---|---|---|---|---|---|---|---|---|---|---|
| | Silver | | | | Acid | | | | | | | | | |
| | Cover- | | Alkoxysilane | | Anhydride | Development | | Room Temp. Aging | | | | Cutting | | |
| Sample | age | Coating | (mol/mol | Coating | (mol/mol | Temp. | Time | (23%, 55%) | | | | Speed | | |
| No. | (g/m$^2$) | Solution | Ag) | Solution | Ag) | (° C.) | (sec) | S | γ | Dmax | Dmin | Slow | Fast | Remark |
| 3-1 | 1.30 | 1 | — | 22 | — | 124 | 13.6 | 90 | 2.58 | 2.05 | 0.188 | 0.07 | 0.08 | Comp. |
| 3-2 | 1.30 | 1 | — | 22 | — | 126 | 13.6 | 92 | 2.64 | 2.19 | 0.189 | 0.08 | 0.09 | Comp. |
| 3-3 | 1.30 | 2 | A-1 (0.0375) | 32 | 0.0313 | 124 | 13.6 | 101 | 3.95 | 3.19 | 0.184 | 0.07 | 0.08 | Inv. |
| 3-4 | 1.30 | 2 | A-1 (0.0375) | 32 | 0.0313 | 126 | 13.6 | 102 | 4.02 | 3.28 | 0.184 | 0.08 | 0.10 | Inv. |
| 3-5 | 1.30 | 2 | A-1 (0.0375) | 32 | 0.0313 | 128 | 13.6 | 104 | 4.08 | 3.45 | 0.185 | 0.07 | 0.09 | Inv. |
| 3-6 | 1.30 | 3 | A-7 (0.0250) | 22 | — | 126 | 13.6 | 102 | 4.23 | 3.27 | 0.186 | 0.07 | 0.10 | Inv. |
| 3-7 | 1.30 | 4 | A-7 (0.0375) | 32 | 0.0313 | 126 | 13.6 | 99 | 3.99 | 3.12 | 0.185 | 0.08 | 0.09 | Inv. |
| 3-8 | 1.30 | 5 | A-7 (0.0375) | 32 | 0.0313 | 126 | 13.6 | 101 | 4.05 | 3.39 | 0.186 | 0.08 | 0.10 | Inv. |
| 3-9 | 1.30 | 6 | A-14 (0.0125) | 32 | 0.0313 | 126 | 13.6 | 98 | 4.06 | 3.19 | 0.186 | 0.07 | 0.09 | Inv. |
| 3-10 | 1.30 | 7 | A-15 (0.0125) | 32 | 0.0313 | 126 | 13.6 | 96 | 3.86 | 3.39 | 0.185 | 0.07 | 0.09 | Inv. |
| 3-11 | 1.30 | 8 | A-21 (0.0125) | 32 | 0.0313 | 126 | 13.6 | 97 | 3.89 | 3.29 | 0.185 | 0.08 | 0.07 | Inv. |

TABLE 4-continued

| Sample No. | Silver Coverage (g/m²) | Interlayer Coating Solution | Interlayer Alkoxysilane (mol/mol Ag) | Image Forming Layer Coating Solution | Image Forming Layer Acid Anhydride (mol/mol Ag) | Development Temp. (° C.) | Development Time (sec) | Room Temp. Aging (23%, 55%) S | γ | Dmax | Dmin | Frilling (mm) Cutting Speed Slow | Fast | Remark |
|---|---|---|---|---|---|---|---|---|---|---|---|---|---|---|
| 3-12 | 1.30 | 9 | A-26 (0.0250) | 22 | 0.0313 | 126 | 13.6 | 99 | 3.96 | 3.26 | 0.186 | 0.08 | 0.09 | Inv. |
| 3-13 | 1.20 | 10 | C-1 (0.2500) | 22 | — | 126 | 13.6 | 125 | 11.19 | 3.18 | 0.195 | 0.12 | 0.16 | Comp. |

As apparent from Table 4, it was proved that samples having an interlayer containing an alkoxysilane relating to the invention exhibited a proper gradation without producing excessively high contrast as well as higher Dmax and minimized fog density, and superior layer adhesion, compared to comparative samples.

Example 4

Preparation of Photothermographic Material

Photothermographic materials were prepared according to the following procedure.

Preparation of Interlayer Coating Solution poly(vinyl butyral) resin (S-lec BL-5Z, available from Sekisui Chemical Co., Ltd.) was dissolved in a solvent comprised of methyl ethyl ketone, toluene and cyclohexane (by weight ratio of 65:30:5) in a concentration of 10% solid to obtain a binder resin solution. Separately, cross-linked acryl resin particles (MX-150, available from SOKEN-KAGAKU Co., Ltd.) were dispersed in 45.0 g of methyl ethyl ketone with stirring by a dissolver to obtain a filler dispersion. To 96 g of the thus prepared binder resin solution, 2.0 g of the filler dispersion was added with stirring and then, an isocyanate compound (colonate HX, available from Nippon Polyurethane Co., Ltd.), which was dissolved in methanol so as to have a concentration of 40% solid, was added thereto in a molar ratio to silver per unit area, as shown in Table 5 to prepare interlayer coating solutions No. 12 through 16. Similarly were prepared coating solution No. 1, in which the the schiff base was not added and coating solution No. 11, in which commonly known hardening agent (C-1), i.e., ethyl 2-(ethoxymethylene)-2-cyanoacetate was added in place of the schiff base.

Coating of Interlayer Coating Solution

The opposite side of a 175 μm thick biaxially stretched polyethylene terephthalate film to the backing layer, which was formed similarly to Example 1, was subjected to a corona discharge treatment (80 W/m²·min). On the side subjected to the corona discharge treatment, the interlayer coating solutions were each coated using an extrusion coater and dried by hot air at 70° C. to form an interlayer with a coverage of 0.30 g/m². The interlayer coating solutions were used within 30 min. after adding the schiff base.

Preparation of Image Forming Layer Coating Solution

Methyl ethyl ketone of 10 g and 50 g of light-sensitive emulsified dispersion that was prepared similarly to Example 1 were mixed and maintained at 21° C., and 0.320 g of antifoggant 1 methanol solution (11.2%) was added thereto and stirred for 1 hr. Further thereto, 0.424 g of calcium bromide methanol solution (11.2%) was added and stirred for 20 min. Further thereto was added a solution, in which 1.00 g of dibenzo-18-crown-6 and 0.31 g of potassium acetate were dissolved in 10.0 g of methanol. Subsequently, 4.395 g of dye solution 1 used in Example 1 was added thereto and stirred for 60 min. and then cooled to a temperature of 13° C. and further stirred for 50 min.

Further thereto, 0.766 g of a methanol solution (0.50%) of a thiuronium compound (Exemplified compound, T-7) was added and after stirred for 5 min., 13.29 g of poly(vinyl butyral) (S-lec BL-5Z, available from Sekisui Chemical Co., Ltd.) and 0.304 g of tetrachlorophthalic acid were added thereto and sufficiently dissolved with stirring.

To the thus obtained solution were successively added methyl ethyl ketone solutions Nos. 1, 2 and 4, used in Example1, and the following solution were successively added with stirring, in an amount of 2.261 g, 13.543 g, 4.597 g and 3.491 g, respectively, to prepare coating solution 33 for an image forming layer. Then, cis-1,2-cyclohexanedicarboxylic acid anhydride, which was dissolved in methyl ethyl ketone (20% solid) was added to the respective coating solutions in a molar ratio to silver per unit area, as shown in Table 5 tp prepare coating solution 34 for an image forming layer.

| Solution 9 | |
|---|---|
| Trihalomethyl-containing Compound (P-15) | 1.543 g |
| Trihalomethyl-containing Compound (P-30) | 0.723 g |
| Methyl ethyl ketone | 10.01 g |

Coating of Image Forming Layer and Protective Layer

On the support having been coated with the interlayer, each of the image forming layer coating solutions and a protective layer coating solution were simultaneously coated in the combination shown in Table 5, using an extrusion coater and dried by hot air at 70° C. to prepare photothermographic material samples. Silver coverage per unit are was adjusted as shown in Table 4 and a protective layer thickness was also adjusted to 2.35±0.15 μm.

Image Recording and Image Evaluation

Image Recording

Photothermographic material samples were each exposed similarly to Example 3 and thermally developed at 126° C. for 13.6 sec. to obtain developed photothermographic material samples 4-1 thorough 4-8.

Image Evaluation

Photothermographic material samples were also evaluated with respect to adhesion of a layer to the support (frilling) similarly to Example 3. Sensitivity was represented by a relative value, based on the sensitivity of photothermographic material sample 1-1 of Example 1 being 100.

TABLE 5

| Sample No. | Silver Coverage (g/m²) | Interlayer Coating Solution | Interlayer Schiff Base (mol/Ag) | Image Forming Layer Coating Solution | Image Forming Layer Acid Anhydride (mol/Ag) | Room Temp. Aging (23%, 55%) S | γ | Dmax | Dmin | Frilling (mm) Cutting Speed Slow | Fast | Remark |
|---|---|---|---|---|---|---|---|---|---|---|---|---|
| 4-1 | 1.30 | 11 | — | 33 | — | 94 | 2.84 | 2.43 | 0.185 | 0.07 | 0.08 | Comp. |
| 4-2 | 1.30 | 12 | S-3 | 33 | — | 100 | 3.84 | 3.29 | 0.187 | 0.07 | 0.09 | Inv. |
| 4-3 | 1.30 | 12 | S-3 | 34 | 0.0313 | 97 | 3.56 | 3.01 | 0.186 | 0.08 | 0.09 | Inv. |
| 4-4 | 1.30 | 13 | S-6 | 34 | 0.0313 | 96 | 3.69 | 3.05 | 0.185 | 0.07 | 0.08 | Inv. |
| 4-5 | 1.30 | 14 | S-6 | 34 | 0.0313 | 99 | 3.89 | 3.39 | 0.186 | 0.08 | 0.09 | Inv. |
| 4-6 | 1.30 | 15 | S-11 | 34 | 0.0313 | 100 | 3.97 | 3.25 | 0.186 | 0.08 | 0.09 | Inv. |
| 4-7 | 1.30 | 16 | S-15 | 34 | 0.0313 | 100 | 3.78 | 3.49 | 0.186 | 0.08 | 0.09 | Inv. |
| 4-8 | 1.20 | 17 | C-1 | 33 | — | 120 | 11.59 | 3.29 | 0.193 | 0.09 | 0.12 | Comp. |

As apparent from Table 5, it was proved that samples having an interlayer containing a schiff base relating to the invention exhibited a proper gradation without producing excessively high contrast as well as enhanced D max and minimized fog density, and superior layer adhesion, compared to comparative samples.

Example 5

Of photothermographic material samples of Examples 1 through 4, samples as shown in Table 6 were imagewise exposed in accordance with the following image recording 1 through 4 and thermally developed at 126° C. for 13.6 sec. using an autoatic processor, similarly to Example 1. Interference fringe of obtained images were evaluated through a sensory test, based on the criteria described below and also evaluated based on densitometry (ΔD). The results thereof are shown in Table 6. Exposure was so controlled that exposure energy on the protective layer surface was the same as in Example 1.

Image Recording 1

Photothermographic material was subjected to laser scanning exposure from the protective layer side, using an exposure apparatus having a light source of 820 nm semiconductor laser. Imagewise exposure was conducted at an angle of 90° between the photothermographic material surface and a laser beam.

Image Recording 2

Photothermographic material was subjected to laser scanning exposure from the protective layer side, using an exposure apparatus having a light source of 820 nm semiconductor laser. Imagewise exposure was conducted at an angle of 70° between the photothermographic material surface and a laser beam.

Image Recording 3

Photothermographic material was subjected to laser scanning exposure from the protective layer side, using an exposure apparatus having a light source of 800 to 820 nm semiconductor laser of a longitudinal multi-mode, which was made by means of high frequency overlapping. Imagewise exposure was conducted at an angle of 90° between the photothermographic material surface and a laser beam.

Image Recording 4

Photothermographic material was subjected to laser scanning exposure from the protective layer side, using an exposure apparatus having a light sources of two 820 nm semiconductor lasers, in which two laser lights emitted from a light source unit are deflection-scanned with a polygon mirror and an image is formed on the photoreceptor through an fθ lens. In this case, an angle between the photothermographic material surface and a laser beam was 85° for one laser light and 95° fro another one, and exposure energy on the protective layer surface was identical and the energy intensity was ½ of the image recording 1.

Sensory Test

An image obtained by subjected photothermographic material to exposure and development so as to give a density of 1.80±0.15 was placed on a viewing box exhibiting a luminance of 10000 and extents of causing interference fringes were visually evaluated, based on the following ranks:

4: no interference fringe was observed;

3: interference fringes were slightly observed;

2: marked interference fringes were partially observed;

1: marked interference fringes were overall observed.

Densitometry (ΔD)

In cases where interference fringes are clearly observed, using a densitometer provided with an adjustable slit opening, image densities are subjected to scanning densitometry to quantitative evaluate the interference fringes as a difference in density between bright and dark fringes. Thus, a photothermographic material was exposed and developed so as to have an image density of 1.80±0.15 and five portions of the obtained image were measured at intervals of 25 m over a length of 20 mm (total measuring points of 4,000) and a density difference (ΔD), as defined below was determined and related with the foregoing sensory test results. The less ΔD value indicates that occurrence of interference fringes is less.

$$D = (\text{maximum density among measured points}) - (\text{minimum density among measured points}).$$

TABLE 6

| Exposure No. | Photothermographic Material | Image Recording | Interference Fringe Sensor Test | ΔD |
|---|---|---|---|---|
| 8-1 | 1-9 | 1 | 3 | 0.021 |
| 8-2 | 1-9 | 2 | 4 | 0.017 |
| 8-3 | 1-9 | 3 | 4 | 0.014 |
| 8-4 | 1-9 | 4 | 4 | 0.011 |
| 8-5 | 1-27 | 1 | 3 | 0.024 |
| 8-6 | 1-27 | 2 | 4 | 0.018 |
| 8-7 | 1-27 | 3 | 4 | 0.016 |
| 8-8 | 1-27 | 4 | 4 | 0.014 |
| 8-9 | 2-9 | 1 | 3 | 0.022 |
| 8-10 | 2-9 | 2 | 4 | 0.018 |
| 8-11 | 2-9 | 3 | 4 | 0.013 |
| 8-12 | 2-9 | 4 | 4 | 0.012 |
| 8-13 | 3-4 | 2 | 4 | 0.018 |
| 8-14 | 3-4 | 3 | 4 | 0.015 |
| 8-15 | 3-4 | 4 | 4 | 0.011 |
| 8-16 | 4-5 | 2 | 4 | 0.019 |
| 8-17 | 4-5 | 3 | 4 | 0.015 |
| 8-18 | 4-5 | 4 | 4 | 0.012 |

As apparent from Table 6, it was shown that when the foregoing image recording was applied to photothermographic materials relating to the invention, superior images were obtained without causing an interference fringe.

What is claimed is:

1. A photothermographic material comprising a support having thereon an image forming layer containing an organic silver salt, photosensitive silver halide and a reducing agent, further thereon a protective layer and optionally an interlayer between the support and the image forming layer, wherein at least one of the image forming layer and the interlayer contains an alkoxy-silane compound having at least two primary or secondary amino groups or a salt thereof or a Schiff base formed through dehydration condensation of an alkoxy-silane compound having at least one primary amino group and a ketone compound.

2. The photothermographic material of claim 1, wherein the interlayer is a layer adjacent to the image forming layer.

3. The photothermographic material of claim 1, wherein the image forming layer contains the alkoxy-silane compound having at least two primary or secondary amino groups or a salt thereof or the Schiff base formed through dehydration condensation of an alkoxy-silane compound containing at least one primary amino group and a ketone compound.

4. The photothermographic material of claim 3, wherein the image forming layer comprises the alkoxy-silane compound containing at least two primary or secondary amino groups or a salt thereof.

5. The photothermographic material of claim 3, wherein the image forming layer comprises the Schiff base formed through dehydration condensation of an alkoxy-silane compound containing at least one primary amino group and a ketone compound.

6. The photothermographic material of claim 1, wherein the interlayer contains the alkoxy-silane compound having at least two primary or secondary amino groups or a salt thereof or the Schiff base formed through dehydration condensation of an alkoxy-silane compound containing at least one primary amino group and a ketone compound.

7. The photothermographic material of claim 6, wherein the interlayer comprises the alkoxy-silane compound containing at least two primary or secondary amino groups or a salt thereof.

8. The photothermographic material of claim 1, wherein the schiff base has at least one secondary amino group.

9. The photothermographic material of claim 1, wherein the image forming layer contains an isocyanate compound having at least two isocyanate groups.

10. The photothermographic material of claim 1, wherein the image forming layer contains an acid anhydride compound.

* * * * *